US006522072B1

(12) United States Patent
Yura et al.

(10) Patent No.: US 6,522,072 B1
(45) Date of Patent: Feb. 18, 2003

(54) PLASMA DISPLAY PANEL AND SUBSTRATE FOR PLASMA DISPLAY PANEL

(75) Inventors: Shinsuke Yura, Tokyo (JP); Kazuya Kawabe, Tokyo (JP); Shigeki Harada, Tokyo (JP); Takashi Hashimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,474

(22) Filed: Sep. 20, 2000

(30) Foreign Application Priority Data

Sep. 21, 1999 (JP) ..... 11-266750
Mar. 27, 2000 (JP) ..... 2000-085838

(51) Int. Cl.[7] ..... H01J 11/02

(52) U.S. Cl. ..... 313/582; 313/491; 313/584; 313/586

(58) Field of Search ..... 313/491, 583, 313/584, 581, 582, 585, 586, 461

(56) References Cited

U.S. PATENT DOCUMENTS 4,276,492 A * 6/1981 Mayer ..... 313/188
4,554,537 A 11/1985 Dick
5,587,624 A 12/1996 Komaki
5,640,068 A 6/1997 Amemiya
5,659,226 A * 8/1997 Shigeta ..... 313/491
5,841,232 A * 11/1998 Hirao et al. ..... 313/585
5,952,781 A * 9/1999 Wang et al. ..... 313/567
6,172,461 B1 * 1/2001 Ha ..... 313/585

FOREIGN PATENT DOCUMENTS

JP 59119644 * 7/1984 ..... 313/584
JP 7065727 * 3/1995 ..... H01J/11/02
JP 8-022772 1/1996
JP 10-149774 6/1998

* cited by examiner

*Primary Examiner*—Ashok Patel
(74) *Attorney, Agent, or Firm*—Oblon, Spivak, McClelland, Maier & Neustadt, P.C.

(57) ABSTRACT

A sustain electrode (10, 20) formed by a metal thick film consists of (i) a base portion (15, 25) extending along a second direction (D2) and (ii) a projecting portion (16, 26) coupled with the base portion (15, 25) to extend toward another sustain electrode (20, 10) with respect to the base portion (15, 25). The projecting portion (16, 26) consists of (ii-1) two first portions (161, 261) coupled with an end of the base portion (15, 25) in the second direction (D2) to extend along a first direction (D1), (ii-2) a second portion (162, 262) coupled with an end of the first portion (161, 261) on the side of the other sustain electrode (20, 10) in the first direction (D1) to extend along the second direction (D2) and connect the two first portions (161, 261) with each other, and (ii-3) a third portion (163, 263) coupled with portions of the first portions (161, 261) separate from the second portion (162, 262) for connecting the two first portions (161, 261) with each other. Luminance of an AC-PDP comprising a sustain electrode consisting of only a metal thick film can be improved.

4 Claims, 18 Drawing Sheets

PLASMA DISPLAY PANEL AND SUBSTRATE FOR PLASMA DISPLAY PANEL

BACKGROUND OF THE INVENTION

1. Field of the Invention

The present invention relates to a plasma display panel (hereinafter referred to also as "PDP"), and more particularly, it relates to a technique of improving display quality such as luminance of an alternating current PDP (hereinafter referred to also as "AC-PDP").

2. Description of the Background Art

FIG. 30 is an exploded perspective view showing a conventional AC-PDP 101P. As shown in FIG. 30, the AC-PDP 101P is roughly classified into a front panel 101FP and a rear panel 101RP.

In the front panel 101FP, a transparent dielectric thin film layer 55P containing no alkaline metal such as sodium (Na) is formed on a main surface of a glass substrate 51 made of soda-lime glass, for example. The dielectric thin film layer 55P is formed through a thin film forming process such as CVD method, for example. In general, the insulation resistance of soda-lime glass or the like is reduced when the temperature is increased, and hence inconvenience may result in operations of the AC-PDP 101P due to heat generated in operation. The dielectric thin film layer 55P is provided for ensuring insulation of sustain electrodes 10P and 20P described later.

Strip-shaped sustain electrodes 10P and 20P forming sustain electrode pairs 30P are formed in parallel with each other through prescribed gaps (discharge gaps) g on the surface of the dielectric thin film layer 55P opposite to glass substrate 51. A plurality of such sustain electrodes 10P and 20P are alternately formed in the form of stripes. The sustain electrodes 10P and 20P consist of transparent electrodes 11P and 21P formed on the aforementioned surface of the dielectric thin film layer 55P and metal electrodes (referred to also as "bus electrodes") 12P and 22P formed on surfaces of the transparent electrodes 11P and 21P opposite to the glass substrate 51.

As described later, display emission is taken out from the side of the glass substrate 51. Therefore, the transparent electrodes 11P and 21P are employed for increasing discharge areas, i.e., electrode areas while not screening visible light converted/generated in fluorescent materials 75R, 75G and 75B described later.

The transparent electrodes 11P and 21P have high electrode resistance, and hence these transparent electrodes 11P and 21P are combined with the metal electrodes 12P and 22P thereby reducing the resistance of the sustain electrodes 10P and 20P.

The transparent electrodes 11P and 21P are prepared from ITO or $SnO_2$, for example, while the metal electrodes 12P and 22P are formed by thick films of Ag or the like or thin films having a three-layer structure of Cr/Cu/Cr or a two-layer structure of Al/Cr, for example.

A black pattern (hereinafter referred to also as "in-electrode black layer") of the same size or shape as the metal electrodes 12P and 22P is formed between the metal electrodes 12P and 22P and the transparent electrodes 11P and 21P, although FIG. 30 omits illustration of such an in-electrode black layer in order to avoid complication. The in-electrode black layer, which must electrically connect the metal electrodes 12P and 22P with the transparent electrodes 11P and 21P, is made of a conductive material.

On the aforementioned surface of the dielectric thin film layer 55P, a stripe-shaped black pattern (the so-called black stripe pattern) 76P is formed between adjacent sustain electrode pairs 30P in parallel with the sustain electrodes 10P and 20P. In order to avoid complication of illustration, FIG. 30 shows the black stripe pattern 76P only in the fragmented portion. Dissimilarly to the aforementioned in-electrode black layer, the black stripe pattern 76P is made of an insulating material. If made of a conductive material, the black stripe pattern 76P disadvantageously serves as an electrode to readily induce discharge (false discharge) between the same and the sustain electrode pairs 30P.

According to the in-electrode black layer and the black stripe pattern 76P, reflection of external light can be more reduced as viewed from the side of the front panel 101FP forming the display surface of the AC-PDP 101P, thereby consequently improving the contrast. The reason for this is as follows: Under light environment, the contrast, decided by the ratio of (i) reflection intensity of external light when the PDP emits no light to (ii) luminous intensity when the PDP emits light, is increased as the reflection intensity of external light is reduced under constant luminous intensity. Therefore, reflection of external light is preferably minimized, as enabled by the in-electrode black layer and the black stripe pattern 76P.

At this time, light generated in a discharge space, defined by the front panel 101FP and the rear panel 101RP, is screened by the opaque metal electrodes 12P and 22P arranged closer to the discharge space than the in-electrode black layer when taken out from the AC-PDP 10P. In addition, the in-electrode black layer is identical in size to the metal electrodes 12P and 22P as described above. In consideration of these points, the numerical aperture, i.e., luminous intensity is not reduced due to provision of the in-electrode black layer.

The black stripe pattern 76P is provided between adjacent discharge cells in the direction perpendicular to the sustain electrodes 10P and 20P. In other words, the black stripe pattern 76P is provided on a region irrelevant to display emission, and hence reduction of luminance is small despite provision of the black stripe pattern 76P.

A transparent dielectric layer 52 is formed to cover the dielectric thin film layer 55P and the sustain electrodes 10P and 20P. The dielectric layer 52 has a role of isolating the sustain electrodes 10P and 20P from each other while isolating the sustain electrodes 10P and 20P from the discharge space defined by the front panel 101FP and the rear panel 101RP or discharge formed in the discharge space. A protective film 53 of MgO, for example, is formed on the dielectric layer 52. The protective film 53 has a role of protecting the dielectric layer 52 from the discharge formed in the discharge space while serving as a secondary-electron emission film for reducing a (discharge) firing voltage.

In the rear panel 101RP, on the other hand, a plurality of strip-shaped write electrodes 72 are formed in the form of stripes on a main surface of a glass substrate 71. A dielectric layer 73 is formed on the aforementioned main surface of the glass substrate 71 to cover the write electrodes 72. Further, barrier ribs (also simply referred to as "ribs") 74 are formed on regions corresponding to those between adjacent two write electrodes 72 on a surface of the dielectric layer 73 opposite to the glass substrate 71. End portions or top portions of the barrier ribs 74 separated from the glass substrate 71 are blackened by a black material, for example. Such black portions 74T, referred to as black stripe or black matrix, act to improve the contrast of display emission.

Fluorescent materials or fluorescent layers 75R, 75G and 75B for emitting light of red (R), green (G) and blue (B) are arranged on inner surfaces of U-shaped trenches defined by adjacent two barrier ribs 74 and the dielectric layer 73 respectively. There is also a rear panel having no dielectric layer 73.

The front panel 101FP and the rear panel 101RP are so arranged that the aforementioned main surfaces of the glass substrates 51 and 71 face each other in such a direction that the sustain electrodes 10P and 20P and the write electrodes 72 three-dimensionally intersect with each other, while the peripheries thereof are airtightly sealed. The striped discharge space defined between the front panel 101FP and the rear panel 101RP and divided by the fluorescent layers 75R, 75G and 75B (may be grasped as divided by the barrier ribs 74) is filled with discharge gas containing xenon (Xe), neon (Ne) or the like. Each of the three-dimensional intersections between the sustain electrode pairs 30P or the discharge gaps g and the write electrodes 72 define a single discharge cell or a single light emitting cell.

The outline of the principle of a display operation on the AC-PDP 101P is as follows: AC pulses are applied to the sustain electrode pairs 30P for discharging the discharge gas through the discharge gaps g and converting ultraviolet rays generated by this discharge to visible light by the fluorescent layers 75R, 75G and 75B. This visible light is taken out from the side of the glass substrate 51 for display emission.

At this time, emission/non-emission of each light emitting cell is controlled as follows: First, discharge (write discharge) is previously formed between the write electrode 72 and the sustain electrode 10P or 20P in the desired light emitting cell(s) for display emission. Wall charges are formed on a portion of the protective film 53 corresponding to the desired light emitting cell(s) due to this discharge. Thereafter a prescribed voltage (sustain voltage) is applied to the sustain electrode pair 30P for causing discharge (sustain discharge) only in the light emitting cell(s) formed with the wall charges. In other words, a sustain voltage of a value causing discharge in the light emitting cell(s) having wall charges while causing no discharge in light emitting cells having no wall charges is applied. Thus, a desired light emitting cell can be selected for emitting light. The sustain voltage can be simultaneously applied all over the AC-PDP 101P.

Transparent conductive thin films of ITO, $SnO_2$ or the like can be applied as the transparent electrodes 11P and 21P, as described above. Frequently employed ITO and $SnO_2$ are now compared with each other. While ITO is superior to $SnO_2$ in conductivity, transparency and patterning workability, but the former is inferior in stability of chemical resistance and heat resistance to the latter. Further, it is difficult for ITO, generally subjected to film formation by physical vapor deposition method such as vacuum deposition, sputtering or ion plating, to satisfy formation over a wide area and mass production.

On the other hand, $SnO_2$ has characteristics opposite to those of ITO. In other words, $SnO_2$ is superior in stability of chemical resistance and heat resistance to ITO. Further, $SnO_2$, generally subjected to film formation by chemical vapor deposition (CVD) method, readily satisfies formation over a wide area and mass production. However, $SnO_2$ is inferior in conductivity and transparency to ITO, and it is difficult for $SnO_2$ to attain patterning in higher precision or higher definition to ITO due to the aforementioned superior stability of chemical resistance. Thus, each of ITO and $SnO_2$ has its merits and demerits, and it is hard to tell which is the best.

As hereinabove described, the sustain electrodes 10P and 20P have the two-layer structure of the transparent electrodes 11P and 21P and the metal electrodes 12P and 22P, and hence the metal electrodes 12P and 22P must be formed in correct alignment. Thus, inconvenience in such alignment results in reduction of the yield.

Japanese Patent Application Laid-Open No. 10-149774 (1998) discloses an AC-PDP capable of rendering material selection of transparent electrodes and alignment unnecessary. FIG. 31 is a typical top plan view showing such an AC-PDP 101P as viewed from the side of a front panel, with extraction and illustration of only a sustain electrode pair 130P and barrier ribs 74.

As shown in FIG. 31, the sustain electrode pair 130P consist of sustain electrodes 110P and 120P, which are formed by four strip-shaped thin electrodes or thin-line electrodes 112*a*P to 112*d*P and four strip-shaped thin electrodes or thin-line electrodes 122*a*P to 122*d*P respectively. The thin-line electrodes 112*a*P to 112*d*P and 122*a*P to 122*d*P are arranged in parallel with each other and perpendicularly to the barrier ribs 74. A clearance between the adjacent thin-line electrodes 112*a*P and 122*a*P defines a discharge gap g, while the remaining thin-line electrodes separate from the discharge gap g in order of the thin-line electrodes 112*b*P and 122*b*P→the thin-line electrodes 112*c*P and 122*c*P→the thin-line electrodes 112*d*P and 122*d*P. The thin-line electrodes 112*a*P to 122*d*P and 112*a*P to 122*d*P are formed not by transparent conductive thin films but by metal thin films having lower resistance than transparent conductive films. Thus, the sustain electrodes 110P and 120P are formed by the thin-line electrodes 112*a*P to 112*d*P and 122*a*P to 122*d*P corresponding to the bus electrodes 12P and 22P respectively.

In the AC-PDP 102P visible light is taken out from clearances between the thin-line electrodes 112*a*P to 112*d*P and 122*a*P to 122*d*P respectively. The sustain electrodes 110P and 120P, formed by the four thin-line electrodes 112*a*P to 112*d*P and the four thin-line electrodes 122*a*P to 122*d*P as described above, can ensure electrode areas or discharge areas to some extent. Therefore, luminance necessary for screen display can be attained to a certain extent without providing the transparent electrodes 11P and 21P provided on the aforementioned AC-PDP 101P.

According to the sustain electrodes 110P and 120P, manufacturing is easier and manufacturing steps are simplified since it is not necessary to form the transparent electrodes 11P and 21P of the AC-PDP 101P. Further, no equipment is necessary for forming transparent electrodes. Consequently, the manufacturing cost can be reduced.

When observing luminous intensity in a single light emitting cell from the side of the front panel in each of the AC-PDPs 101P and 102P, its distribution has the following general tendencies. This is described with reference to FIG. 32. FIG. 32 shows a typical top plan view of the AC-PDP 101P, extracting and illustrating only the transparent electrode 11P and the barrier ribs 74, luminance distribution along the longitudinal direction of the transparent electrodes 11P and 21P, and luminance distribution along the longitudinal direction of the barrier ribs 74.

First, there is such a tendency that the luminance is increased as approaching side surfaces of the barrier ribs 74, as shown in FIG. 32. This is conceivably because portions of the fluorescent layers 75R, 75G and 75B located on the aforementioned side surfaces (particularly portions close to the sustain electrodes 10P and 20P) are irradiated with a larger quantity of ultraviolet rays since the same are closer to the discharge gaps g than portions located on the dielectric layer 73 (see FIG. 30). The aforementioned portions of the fluorescent layers 75R, 75G and 75B have smaller loss when taking out visible light from the AC-PDP 101P since the same are closer to the glass substrate 51. Further, there is such a tendency that the luminance is increased as approaching the discharge gaps g, as shown in FIG. 32. This is conceivably because the discharge strength, i.e., the quantity of ultraviolet rays is at the maximum around the discharge gaps g and reduced as separated from the discharge gaps g. According to these, it is understood that the luminance is increased as approaching both the discharge gaps g and the barrier ribs 74.

In consideration of the luminance distribution shown in FIG. 32, it is hard to say that the quantity of visible light taken out from the AC-PDP 102P, i.e., the luminance of the AC-PDP 102P is optimized or maximized. This is because the thin-line electrodes 112*a*P to 112*d*P and 122*a*P to 122*d*P, (three-dimensionally) intersecting with the barrier ribs 74, screen high-luminance emission around the discharge gaps g and the barrier ribs 74, as understood when observing FIG. 31.

When increasing the distances between the adjacent ones of the thin-line electrodes 112*a*P to 112*d*P and 122*a*P to 122*d*P, it is possible to increase the numerical aperture and improve the quantity of the taken-out light, i.e., the luminance. When increasing the aforementioned distances, however, the thin-line electrodes 112*a*P to 112*d*P and 122*a*P to 122*d*P serve as independent electrodes respectively and hence it is difficult to form electric fields formed by the sustain electrodes 110P and 120P, to be integrally formed by the four thin-line electrodes 112*a*P to 112*d*P and the four thin-line electrodes 122*a*P to 122*d*P.

When changing the voltage applied to the sustain electrodes 110P and 120P, therefore, there appears such a phenomenon that discharge spreads in a plurality of stages of steps as discharge between the thin-line electrodes 112*a*P and 122*a*P→discharge between the thin-line electrodes 112*b*P and 122*b*P→. . . , Such a phenomenon may unstabilize discharge depending on the set value of the voltage applied to the sustain electrodes 110P and 120P. In other words, this phenomenon may cause such a situation that discharge cells forming discharge between the thin-line electrodes 112*b*P and 122*b*P and between the thin-line electrodes 112*c*P and 122*c*P are intermixed, for example. Such instability of discharge, observed as luminance unevenness, reduces discharge quality of the AC-PDP. In order to eliminate such instability of discharge, the set voltage must be extremely correctly controlled.

While the width of the thin-line electrodes 112*a*P to 112*d*P and 122*a*P to 122*d*P themselves may be reduced in order to increase the numerical aperture, patterning is disadvantageously rendered difficult as the width is reduced.

Although the in-electrode black layer and the black stripe pattern 76P of the AC-PDP 101P attain similar functions/effects of improving the contrast, the in-electrode black layer made of a conductive material and the black stripe pattern 76P made of an insulating material. Therefore, the in-electrode black layer and the black stripe pattern 76P must disadvantageously be formed through different steps.

SUMMARY OF THE INVENTION

A substrate for a plasma display panel according to a first aspect of the present invention comprises a transparent substrate and at least one pair of electrodes arranged on the side of one main surface of the transparent substrate each having a base portion and a projecting portion which is coupled with the base portion and projects from the base portion along the main surface, while the electrodes are formed only by an opaque conductive material and the projecting portions of the electrodes project toward each other to form a discharge gap between the projecting portions.

According to the first aspect, the respective projecting portions project from the respective base portions toward each other. In other words, the base portions are present on positions separate from the discharge gap. When applying the substrate for a plasma display panel to a plasma display panel, therefore, the quantity of visible light screened by the base portions is smaller as compared with a structure having base portions around a discharge gap. Therefore, a larger quantity of visible light can be taken out. Thus, the substrate for a plasma display panel can provide a plasma display panel having high luminance.

According to a second aspect of the present invention, each of the projecting portions includes a first portion coupled with the base portion to extend in a projecting direction of the projecting portion and a second portion coupled with an end of the first portion separated from the base portion, and the second portions of the projecting portions face each other to form the discharge gap.

According to the second aspect, the quantity of visible light screened by the projecting portion can be reduced by setting a T shape, for example, by the first and second portions. Thus, a plasma display panel of high luminance can be provided.

Further, the second portion forming the discharge gap is coupled with the first portion, whereby discharge caused in the discharge gap can be expanded toward the base portion through (not a plurality of stages of steps but) a single step also when an applied voltage is increased. Therefore, a plasma display panel having no luminance unevenness resulting from expansion of discharge through a plurality of stages of steps can be provided. In addition, a set margin for the applied voltage can be more widened as compared with the aforementioned conventional plasma display panel.

According to a third aspect of the present invention, the projecting portion has a shape including at least one of an O shape, an L shape and a U shape.

According to the third aspect, the projecting portion includes at least one of an O shape, an L shape and a U shape, whereby it is possible to provide a plasma display panel capable of taking out a larger quantity of visible light through an opening or a clearance defined by such a shape. In this case, the projecting portion can be reliably patterned by defining a U-shaped projecting portion by two first portions and the second portion.

According to a fourth aspect of the present invention, the projecting portion has a discharge-gap-forming-portion facing the discharge gap to form the discharge gap, and the discharge-gap-forming-portion is shorter than a remaining portion of the projecting portion other than the discharge-gap-forming-portion along a direction perpendicular to a projecting direction of the projecting portion.

According to the fourth aspect, high-intensity emission around the discharge gap can be taken out in a larger quantity, whereby luminance and luminous efficiency can be improved.

According to a fifth aspect of the present invention, the at least one pair of electrodes includes a plurality of pairs of electrodes arranged at a prescribed pitch in a projecting direction of the projecting portion, and satisfies the following relation:

$$b<(p-g-115)/2.42$$

assuming that p ($\mu$m) represents the prescribed pitch while b ($\mu$m) and g ($\mu$m) represent the lengths of the projecting portion and the discharge gap in a projecting direction respectively.

According to the fifth aspect, it is possible to provide a plasma display panel capable of suppressing false discharge between electrode pairs adjacent to each other in the projecting direction of the projecting portion.

According to a sixth aspect of the present invention, the at least one pair of electrodes includes a plurality of pairs of electrodes arranged in a projecting direction of the projecting portion, and the substrate for a plasma display panel further comprises a black insulating layer arranged between the pairs of electrodes and the transparent substrate and between adjacent ones of the pairs of electrodes.

According to the sixth aspect, contrast can be improved by the black insulating layer. When preparing respective portions located between the electrode pairs and the transparent substrate and between adjacent ones of the electrode pairs from the same material, both portions can be simultaneously formed.

According to a seventh aspect of the present invention, the at least one pair of electrodes includes a plurality of pairs of electrodes, and electrode areas of all projecting portions are not identical to each other.

According to the seventh aspect, the discharge current quantity can be set for each projecting portion (or each discharge cell). Therefore, it is possible to provide a plasma display panel improved in luminance and/or having a desired white color temperature by setting the discharge current quantity, i.e., setting the quantity of ultraviolet rays.

According to an eighth aspect of the present invention, the substrate for a plasma display panel further comprises a dielectric layer covering the projecting portions, and the electrode area of each projecting portion is set on the basis of thickness of a portion of the dielectric layer covering each projecting portion.

According to the eighth aspect, it is possible to provide, when the dielectric layer has thickness distribution, a plasma display improved prevented from luminance unevenness with respect to this distribution.

According to a ninth aspect of the present invention, the substrate for a plasma display panel further comprises a secondary-electron emission film over the projecting portions, and the electrode area of each projecting portion is set on the basis of secondary-electron emission efficiency of a portion of the secondary-electron emission film corresponding to each projecting portion.

According to the ninth aspect, it is possible to provide, when secondary-electron emission efficiency of the secondary-electron emission film has distribution, a plasma display panel prevented from luminance unevenness corresponding to the distribution.

According to a tenth aspect of the present invention, the substrate for a plasma display panel further comprises an underlayer arranged between the transparent substrate and the electrodes in contact with the electrodes, formed by a transparent dielectric substance formed at a temperature below the softening point of the transparent substrate, and the electrodes are formed by applying and sintering a paste material of the opaque conductive material.

According to the tenth aspect, the underlayer consists of a dielectric substance formed at a temperature below the softening point of the transparent substrate and the electrodes are formed by applying and sintering a paste material of the opaque conductive material. Therefore, the so-called edge curls can be remarkably reduced by setting the sintering temperature for the paste material of the aforementioned opaque conductive material to a level capable of softening the underlayer. Further, the transparent substrate is not thermally deformed at this time. Thus, it is possible to provide a stably operating plasma display panel with no insulative inconvenience resulting from edge curls of the dielectric layer covering the projecting portion.

A plasma display panel according to an eleventh aspect of the present invention comprises a first substrate including the substrate for a plasma display panel according to any one of the first to tenth aspects, a second substrate, including a strip-shaped counter electrode, arranged to face the first substrate, a barrier rib arranged between the first and second substrates to extend along the counter electrode, and a fluorescent layer arranged on a side surface of the barrier rib, while the projecting portion and the barrier rib do not overlap with each other as viewed from the side of the first substrate.

According to the eleventh aspect, the projecting portion and the barrier rib do not overlap with each other as viewed from the side of the first substrate, so that the projecting portion does not screen visible light emitted from the fluorescent layer on the side surface of the barrier rib. Therefore, high luminance can be attained by taking out a larger quantity of visible light.

According to a twelfth aspect of the present invention, the barrier rib is separated from a portion of the projecting portion extending in a projecting direction of the projecting portion by at least 70 $\mu$m as viewed from the side of the first substrate.

According to the twelfth aspect, the aforementioned effect of the eleventh aspect can be more reliably and more remarkably attained.

A plasma display panel according to a thirteenth aspect of the present invention comprises a first substrate including the substrate for a plasma display panel according to the fourth aspect, a second substrate, including plurality of strip-shaped counter electrodes, arranged to face the first substrate such that each electrode has a plurality of projecting portions, and the plasma display panel further comprises a plurality of barrier ribs, extending between the first and second substrates along the counter electrodes, arranged alternately with the counter electrodes not to overlap with the projecting portions as viewed from the side of the first substrate, and a plurality of fluorescent layers arranged on facing side surfaces of adjacent ones of barrier ribs for emitting prescribed luminescent colors defined in units of spaces partitioned by the first and second substrates and the barrier ribs, while an electrode area of each projecting portion is set for every prescribed luminescent color of the fluorescent layer in the space where each projecting portion faces.

According to the thirteenth aspect, difference in luminous intensity among emitted luminescent colors can be corrected when applying the same quantity of ultraviolet rays. Thus, a desired white color temperature can be obtained.

A first object of the present invention is to provide a plasma display panel capable of attaining high-intensity emission while comprising electrodes of an opaque conductive material such as a metal and a substrate for a plasma display panel capable of implementing such a plasma display panel.

A second object of the present invention is to provide a plasma display panel suppressed in luminance unevenness etc. to exhibit high display quality and a substrate for a plasma display panel capable of implementing such a plasma display panel along with implementation of the first object.

A third object of the present invention is to provide a substrate for a plasma display panel having reliably pattern-formable electrodes.

A fourth object of the present invention is to provide a plasma display panel and a substrate for a plasma display panel capable of suppressing false discharge between adjacent electrode pairs.

A fifth object of the present invention is to provide a plasma display panel and a substrate for a plasma display panel capable of improving contrast.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Embodiment 1>

Figure 1:
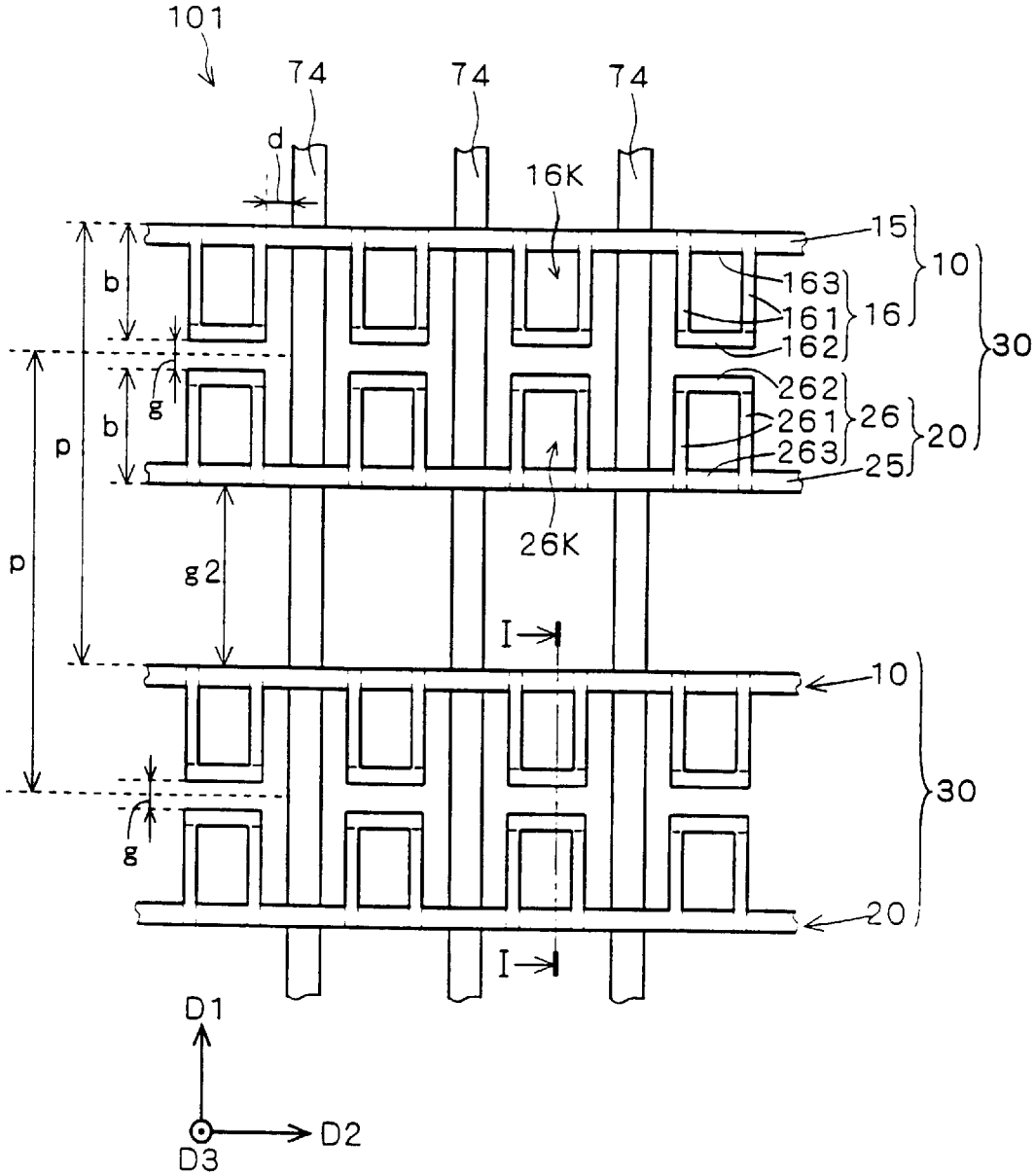
FIG. 1 is a typical top plan view for illustrating an electrode structure of an AC-PDP according to an embodiment 1 of the present invention.
Figure 2:
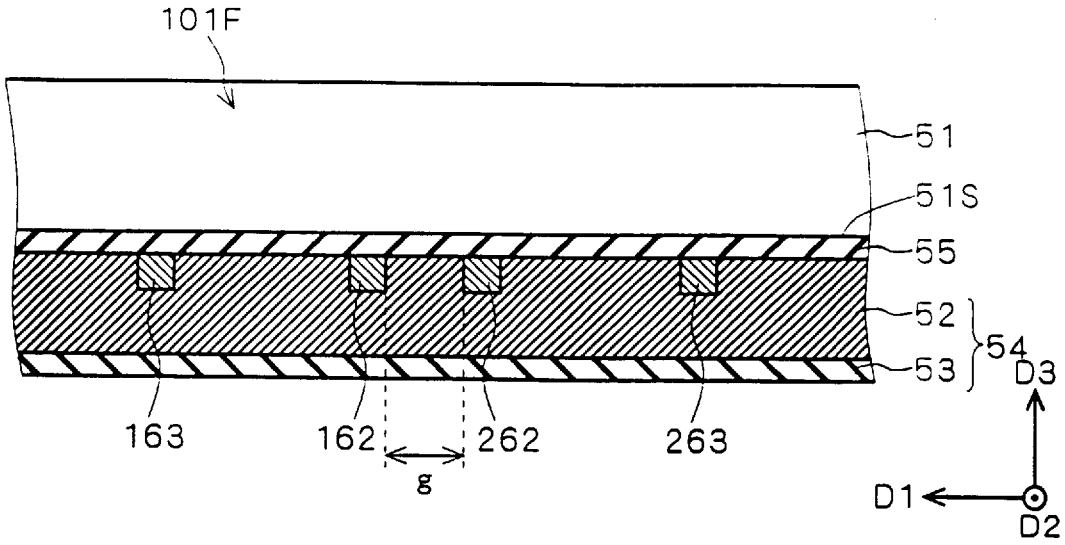
FIG. 2 is a typical longitudinal sectional view for illustrating the AC-PDP according to the embodiment 1.

An AC-PDP 101 according to an embodiment 1 of the present invention is described with reference to FIGS. 1 and 2. FIG. 1 is a typical top plan view for illustrating the structure of the AC-PDP 101, and FIG. 2 is a typical longitudinal sectional view taken along the line I-I in FIG. 1 as viewed from arrows. The feature of the AC-PDP 101 resides in the structure of a front panel or a front substrate (a substrate for a plasma display panel or a first substrate) 101F, particularly in the structure of sustain electrode pairs (electrode pairs) 30. Therefore, FIG. 1 extracts and illustrates the sustain electrode pairs 30 and barrier ribs 74 while FIG. 2 extracts and illustrates the front panel 101F for convenience of illustration.

In the following description, the conventional rear panel 101RP shown in FIG. 30 (not shown in FIGS. 1 and 2) is applied to a rear panel or a rear substrate (a second substrate) of each of the AC-PDP 101 and AC-PDPs according to embodiments 2 to 7 described later. Therefore, the following description is made also with reference to FIG. 30 described above. Each of the AC-PDP 101 and the AC-PDPs according to the embodiments 2 to 7 described later is the so-called three-electrode surface discharge AC-PDP, and various rear panels used for the three-electrode surface discharge AC-PDP are applicable to the aforementioned AC-PDP 101 or the like.

The front panel 101F comprises a glass substrate (a transparent substrate) 51 consisting of soda-lime glass or high strain point glass, for example. A main surface 51S of the glass substrate 51 is parallel to first and second directions D1 and D2 perpendicular to each other. In other words, the main surface 51S is perpendicular to a third direction D3 perpendicular to both first and second directions D1 and D2.

An underlayer 55 consisting of transparent dielectric glass is formed on the main surface 51S of the glass substrate 51.

The underlayer 55 consists of low melting point glass containing no alkaline metal such as sodium (Na). The thickness of the underlayer 55 is about 5 to 10 μm. The underlayer 55 is formed as follows: First, a material prepared by adding resin, a solvent etc. to glass powder for forming paste (the so-called low melting point glass paste material) is applied onto the main surface 51S by screen printing, die coating or roll coating. Thereafter the aforementioned paste material is dried at a prescribed temperature and sintered at a sintering temperature of about 550° C. to 600° C., for example. At this time, the maximum temperature in the step of forming the underlayer 55 is set to a level below the softening point of the glass substrate 51 for suppressing thermal deformation. To this end, the aforementioned low melting point glass paste material refers to a material that can be sintered at a temperature below the softening point of the glass substrate 51, and a dielectric substance prepared from this low melting point glass paste material is referred to as "low melting point glass".

The sustain electrode pairs 30 are formed on a surface of the underlayer 55 opposite to the aforementioned main surface 51S (therefore, the sustain electrode pairs 30 are arranged closer to the main surface 51S of the glass substrate 51). Each sustain electrode pair 30 is formed by two sustain electrodes 10 and 20 paired with each other. The sustain electrodes 10 and 20, consisting of a material containing silver (Ag) in the following description, may alternatively be prepared from another opaque conductive material. In this case, the material preferably has high reflectance similarly to Ag, for example, so that screening by the sustain electrodes 10 and 20 can be substantially weakened. This is because light, emitted in a discharge cell, screened by the sustain electrodes 10 and 20 is reflected on the surfaces of the electrodes 10 and 20 and further reflected on an inner wall of the discharge cell so that the light can be finally taken out from the side of the front panel 101F.

Each sustain electrode 10 is roughly classified into (i) a base portion 15 extending along the second direction D2 and (ii) a branch portion or a projecting portion 16 coupled with the base portion 15 to extend toward the sustain electrode 20 with respect to the base portion 15. A plurality of base portions 15 and a plurality of projecting portions 16 are alternately arranged along the second direction D2, and the plurality of projecting portions 16 are connected through the base portions 15. In this case, the projecting portions 16 project toward the other sustain electrode 20 with respect to the arrangement or series of the plurality of base portions 15.

Each projecting portion 16 is formed by first to third portions 161 to 163 coupled in the form of a frame or an O shape, and the first to third portions 161 to 163 define an opening 16K. More specifically, (ii-1) the first portions 161 are coupled with ends of the base portion 15 in the second direction D2, and extends along the first direction D1. The first portions 161 of the projecting portion 16 are formed on respective ones of two adjacent base portions 15. (ii-2) The second portion 162 is coupled with ends of the first portions 161 in the first direction D1 closer to the other sustain electrode 20, and extends along the second direction D2. The second portion 162 connects the aforementioned two first portions 161 with each other. (ii-3) The third portion 163 is coupled with sides of the first portions 161 separated from the second portion 162, and connects the aforementioned two first portions 161 with each other.

In the AC-PDP 101, the third portion 163, the base portion 15 and parts of the first portions 161 held between the third portion 163 and the base portion 15 are integrated with each other, and a plurality of these form strip-shaped electrodes. According to such a structure, the projecting portion 16 and a projecting portion 26 project toward each other from the base portion 15 and a base portion 25. In other words, the base portions 15 and 25 are present on positions far or separated from a discharge gap g described later.

Each sustain electrode 20 has the base portion 25 equivalent to the aforementioned base portion 15 and the projecting portion or a branch portion 26 equivalent to the aforementioned projecting portion 16. The projecting portion 26 is formed by first to third portions 261 to 263 equivalent to the aforementioned first to third portions 161 to 163 respectively. The first to third portions 261 to 263 define an opening 26K equivalent to the aforementioned opening 16K.

The two sustain electrodes 10 and 20 are line-symmetrically arranged in relation to a symmetrical line (not shown) along the second direction D2. In this case, the projecting portions 16 and 26, more specifically the second portions 162 and 262 face each other through a prescribed clearance (defining the discharge gap g) and arranged parallel to each other.

On the other hand, the distance g2 between the sustain electrode pairs 30 arranged along the first direction D1, more specifically the distance g2 between (i) the projecting portions 16 and 26 of a sustain electrode pair 30 and (ii) the projecting portions 26 and 16 of another sustain electrode pair 30 adjacent to this sustain electrode pair 30 is set to a value causing no false discharge between the adjacent sustain electrode pairs 30. Size setting of the distance g2 between the adjacent sustain electrode pairs 30 is now described in detail.

The aforementioned false discharge is caused in sustain discharge, for example. While sustain discharge is formed only in the discharge cell(s) having wall charges, an alternating voltage is applied to all sustain electrode pairs 30 in an operation for forming sustain discharge. When discharge spreads toward the adjacent discharge cell(s) having no wall charges due to a small distance g2, therefore, discharge (false discharge) is disadvantageously induced also in the aforementioned discharge cell(s) having no wall charges. In consideration of this point, the distance g2 is defined as follows, not to exert discharge between the adjacent discharge cells.

Figure 3:
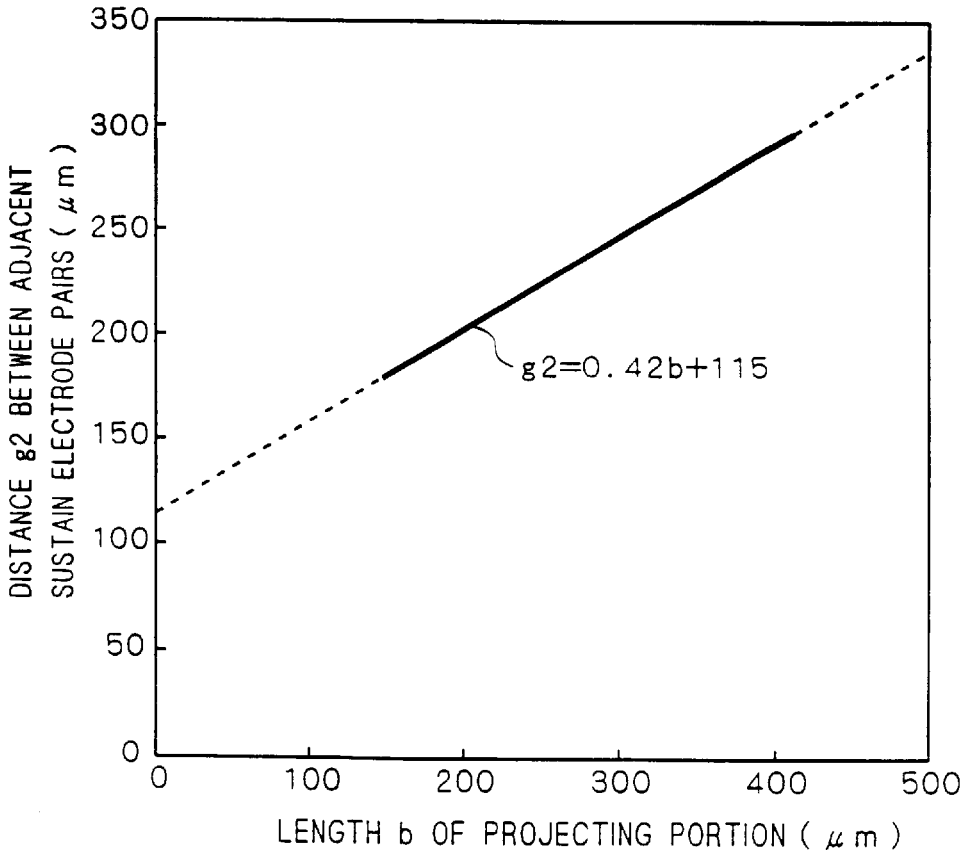
FIG. 3 illustrates the relation between the length of projecting portions and the distance between adjacent sustain electrode pairs in relation to occurrence/non-occurrence of false discharge.

FIG. 3 is a graph showing a result of the relation between the length b (μm) of each of the projecting portions 16 and 26 along the first direction D1 and the distance g2 (μm) in relation to occurrence/non-occurrence of false discharge. False discharge is hardly or not caused in a region above a boundary of a straight line shown in FIG. 3 satisfying the following relation:

$$g2=0.42b+115$$

i.e., in the following region:

$$g2>0.42b+115 \quad (1)$$

The pitch p (μm) of discharge cells along the first direction D1 is defined as the distance between discharge gaps g adjacent to each other in the same direction or the distance between the sustain electrodes 10 or 20 of the adjacent sustain electrode pairs 30. As understood from FIG. 1, there is the following relation:

$$p=2\times b+g+g2 \quad (2)$$

From the above equations (1) and (2), the following relational expression is derived:

$$b<(p-g-115)/2.42 \quad (3)$$

The pitch p of the discharge cells is decided from design or standards of PDPs and the value of the discharge gap g is decided from a (discharge) firing voltage, and hence the length b (μm) of each of the projecting portions 16 and 26 is decided within the range satisfying the above expression (3) on the basis of these values p (μm) and g (μm) in the AC-PDP 101. Thus, false discharge between the sustain electrode pairs 30 arranged along the first direction D1 can be reliably suppressed.

The sustain electrodes 10 and 20 are formed as follows: First, a photosensitive paste material containing Ag (hereinafter simply referred to also as "Ag paste") is applied onto the aforementioned surface of the underlayer 55 by screen printing or the like and dried. The Ag paste is exposed and developed to be patterned into the aforementioned shape and sintered thereby forming the sustain electrodes 10 and 20. At this time, the sintering temperature is set in the range of about 550° C. to 600° C., for example.

The sustain electrodes 10 and 20 can alternatively prepared from Ag paste having no photosensitivity. In this case, a patterned resist film is arranged on dried Ag paste for pattern-etching the Ag paste through a mask of the resist film. Alternatively, Ag paste (having no photosensitivity) may be patterned by a lift-off method. The sustain electrodes 10 and 20 may further alternatively be prepared by another method or may be formed by a paste material of another opaque conductive material.

A dielectric layer 52 consisting of transparent dielectric glass is formed to cover the sustain electrode pairs 30 and the underlayer 55, while a protective film (a secondary-electron emission film) 53 is formed on a surface of the dielectric layer 52 opposite to the substrate 51. At this time, the protective film 53 is formed over the sustain electrode pairs 30. A structure formed by the dielectric layer 52 and the protective film 53 is referred to also as "dielectric layer 54". The dielectric layer 52 is formed by a method similar to the aforementioned method of forming the underlayer 55. The protective film 53 is made of magnesium oxide (MgO), for example, and formed by vacuum deposition or the like.

The front panel 101F and the rear panel 101RP (see FIG. 30) are so arranged that the barrier ribs 74 (extending along the first direction D1) and the base portions 15 and 25 of the sustain electrodes 10 and 20 (three-dimensionally) intersect with each other, and the peripheral edge portions thereof are airtightly sealed. A discharge space defined by the front panel 101F and the rear panel 101RP is filled with prescribed discharge gas. The three-dimensional intersection between each sustain electrode pair 30 or each discharge gap g and each write electrode 72 forms a single discharge cell or a single light emitting cell.

In particular, the sizes, shapes and arrangement positions of the sustain electrodes 10 and 20 and the barrier ribs 74 are so set that the projecting portions 16 and 26 do not overlap with the barrier ribs 74 when observing the front panel 101F of the AC-PDP 101 from the third direction D3, as shown in FIG. 1.

When observing the AC-PDP 101 from the side of the front panel 101F, further, (the minimum value of) the space or the distance d between the first portions 161 and 261 and the barrier ribs 74 is set to at least about 70 μm. This point is now described in detail.

Figure 4:
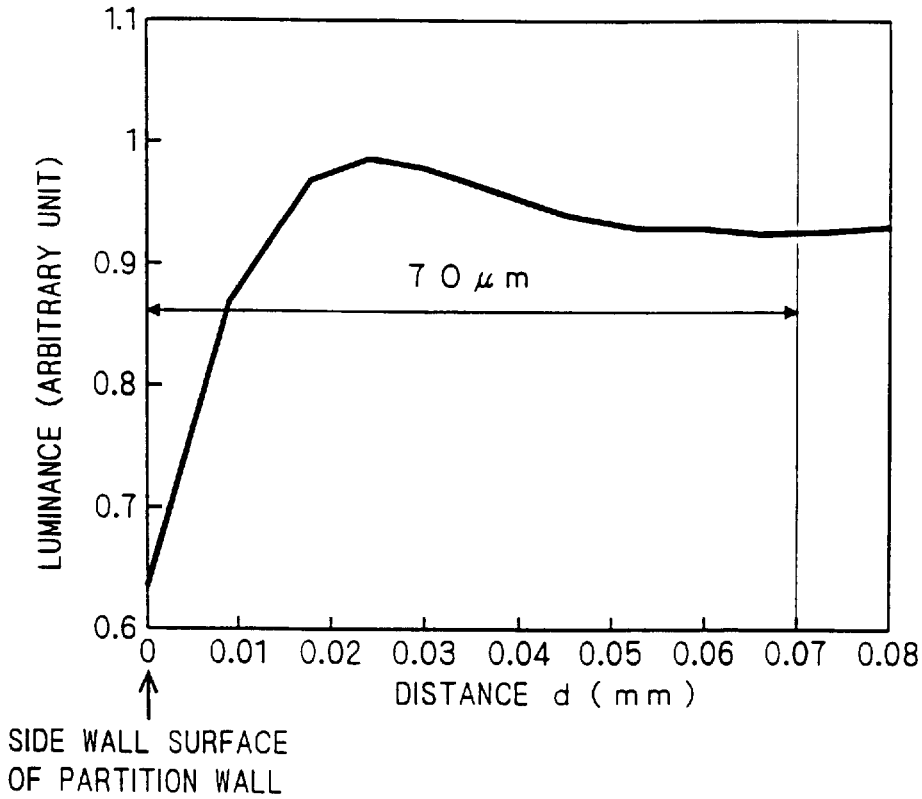
FIG. 4 is a graph for illustrating luminance distribution in the vicinity of barrier ribs.
Figure 32:
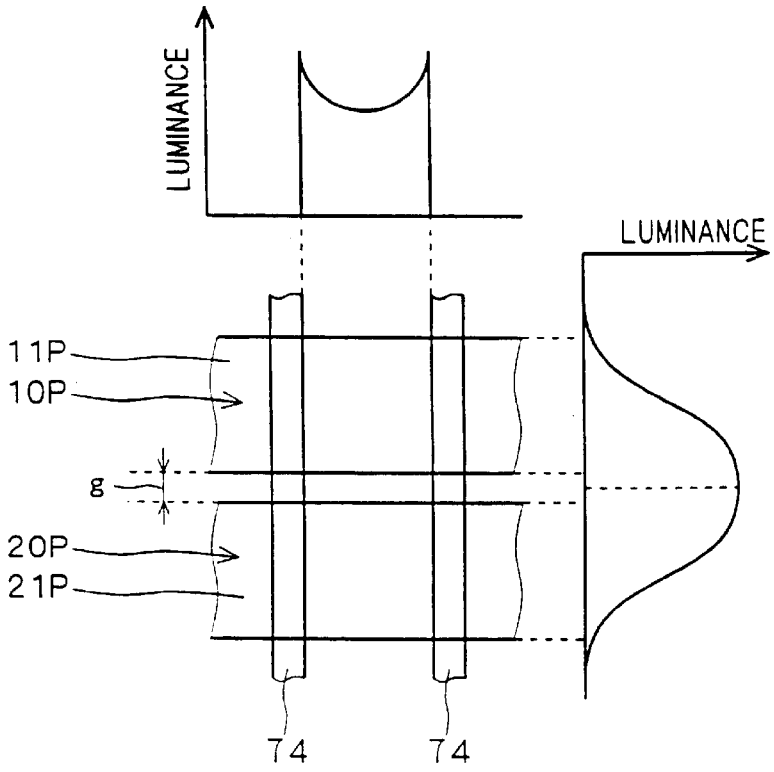
FIG. 32 BACKGROUND ART
FIG. 32 is a model diagram showing luminance distribution of the conventional AC-PDP.

FIG. 4 shows the details of luminance distribution in the vicinity of the barrier ribs 74 in FIG. 32 described above. FIG. 4 is a graph showing a result of intensity or luminance of light emission through the transparent electrode 11P or 21P of the conventional AC-PDP 101P (see FIG. 30) along the direction perpendicular to the barrier ribs 74 (corresponding to the second direction D2 shown in FIG. 1 etc.). According to FIG. 4, luminance is relatively high in the range up to about 70 μm from the side surfaces of the barrier ribs 74, and luminance is hardly reduced when separating by at least about 70 μm.

In consideration of this point, the distance d between the projecting portions 16 and 26 and the barrier ribs 74 is set to at least about 70 μm in the AC-PDP 101, not to screen portions having high luminance in the vicinity of the barrier ribs 74.

When referring to a structure formed by the glass substrate 71 (see FIG. 30) and the strip-shaped write electrodes (counter electrodes) 72 (see FIG. 30) as "second substrate" in the rear panel 101RP, the structure of the AC-PDP 101 can be grasped as follows: The barrier ribs 74 extending along the write electrodes 72 are arranged between the front panel (first substrate) 101F and the second substrate, and parts of fluorescent layers 75R, 75G and 75B (see FIG. 30) are arranged on the side surfaces of the barrier ribs 74. In this case, the fluorescent layers 75R, 75G and 75B consisting of a fluorescent material defined in units of spaces divided by the front panel 101F, the second substrate and the barrier ribs 74 are arranged on facing side surfaces of adjacent barrier ribs 74.

Figure 30:
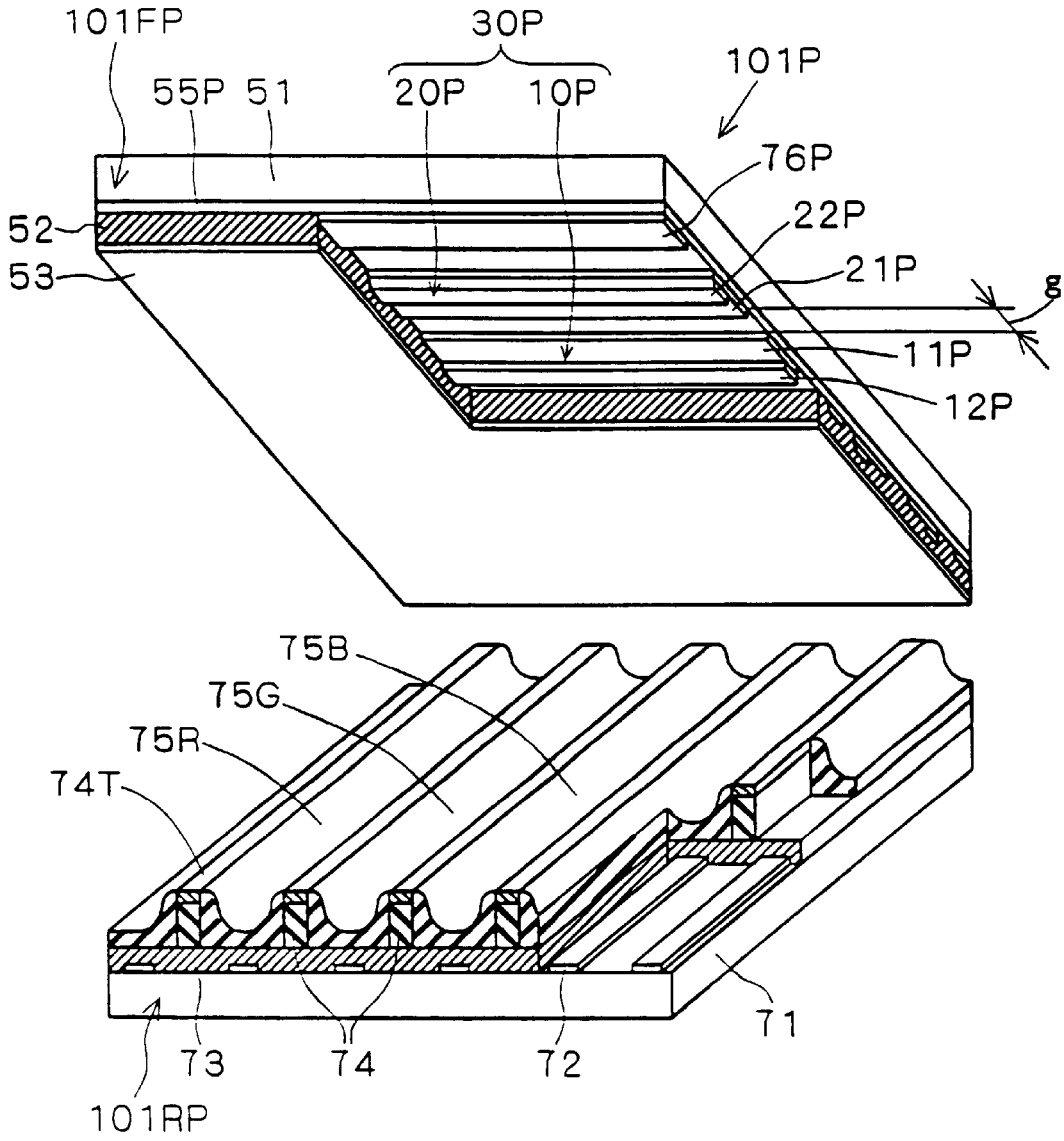
FIG. 30 PRIOR ART
FIG. 30 is an exploded perspective view for illustrating the structure of a conventional AC-PDP.

The AC-PDP 101 can attain the following effects:

First, the AC-PDP 101 having no transparent electrodes dissimilarly to the conventional AC-PDP 101P shown in FIG. 30 requires no selection of a material for transparent electrodes. Further, the sustain electrodes 10 and 20 are not formed by a two-layer structure of transparent electrodes and bus electrodes (metal electrodes) dissimilarly to the sustain electrodes 10P and 20P of the conventional AC-PDP 101P, and hence no alignment is required for forming such a two-layer structure. In addition, no apparatus may be prepared for forming such transparent electrodes and bus electrodes while no material is required for forming transparent electrodes, whereby the manufacturing cost can be reduced.

While the sustain electrodes 110P and 120P are formed by multilayer thin films of Cr/Cu/Cr or Al/Cr in the aforementioned gazette of Japanese Patent Application Laid-Open No. 10-149774 (1998) disclosing the AC-PDP 102P, the sustain electrodes 10 and 20 of the AC-PDP 101 are formed by thick films obtained through a thick film forming process employing Ag paste and hence have smaller electric resistance than the aforementioned thin film multilayer structures. Further, the cost for a manufacturing apparatus is reduced while the manufacturing method is simpler than the thin film forming process.

Japanese Patent Application Laid-Open No. 8-22772 (1996) discloses such an electrode structure that each of sustain electrodes forming a sustain electrode pair consists of a body portion extending in the horizontal direction and a projecting portion projecting from the body portion toward another sustain electrode. In this gazette, however, the aforementioned sustain electrodes are made of only a transparent electrode material, dissimilarly to the aforementioned sustain electrodes 10 and 20 consisting of only an opaque conductive material. When merely replacing the sustain electrodes 10 and 20 with transparent electrodes, the resistance disadvantageously exceeds that of the sustain electrodes 10 and 20.

In particular, the following effect can be attained by the combination of the underlayer 55 consisting of low melting point glass and the sustain electrodes 10 and 20 of thick films: When forming thick-film electrodes equivalent to the sustain electrodes 10 and 20 on a thin-film dielectric layer such as the dielectric thin-film layer 55P (see FIG. 30) of the conventional AC-PDP 101P in general, corner portions or edges (in a longitudinal section) swell in sintering of the thick-film electrodes (such swelling is referred to as "edge curls"). Such edge curls can be remarkably reduced due to the combination of the underlayer 55 consisting of low melting point glass and the sustain electrodes 10 and 20 of thick films.

Such a function of suppressing edge curls is conceivably attained since the underlayer 55 is softened when sintering the dielectric layer 52, for example, and surface tension of the underlayer 55 resulting from such softening pulls the sustain electrodes 10 and 20. When forming the dielectric layer 52 on thick-film electrodes having the aforementioned edge curls, inconvenience in insulation of the dielectric layer 52 readily takes place in the vicinity of the edge curls since the thickness of the dielectric layer 52 in the vicinity of the edge curls is smaller than the thickness on the remaining portions of the thick-film electrodes due to the height of the edge curls.

On the other hand, the AC-PDP 101 or the front panel 101F can suppress formation of edge curls of the sustain electrodes 10 and 20, whereby the dielectric layer 52 (or 54) has a uniform thickness on the sustain electrodes 10 and 20. Therefore, the aforementioned inconvenience in insulation of the dielectric layer 52 does not take place but stable operations of the AC-PDP 101 can be obtained. Further, the underlayer 55 is formed at a temperature below the softening point of the transparent substrate suppressing thermal deformation, whereby the glass substrate 51 is not thermally deformed also in the aforementioned softening.

In addition, the underlayer 55 is formed by applying a low melting point glass paste material by screen printing or the like and drying/sintering the same as described above, whereby the cost for the manufacturing apparatus can be reduced as compared with that for a thin-film forming process such as CVD for forming the conventional dielectric thin-film layer 55P, so that the underlayer 55 can be formed at a low cost.

Further, a manufacturing apparatus for thick film formation such as screen printing can be shared for forming other thick films such as the dielectric layer 52 and the sustain electrodes 10 and 20, for example, and hence it can be said that the effect of reducing the cost for the manufacturing apparatus is remarkable.

Further, the AC-PDP 101 can more improve luminous efficiency as compared with the conventional AC-PDP 102P. This point is now described in detail.

First, the projecting portions 16 and 26 and the barrier ribs 74 separate from each other by at least about 70 $\mu$m, and hence emission of high luminance can be taken out in the vicinity of the barrier ribs 74.

Figure 31:
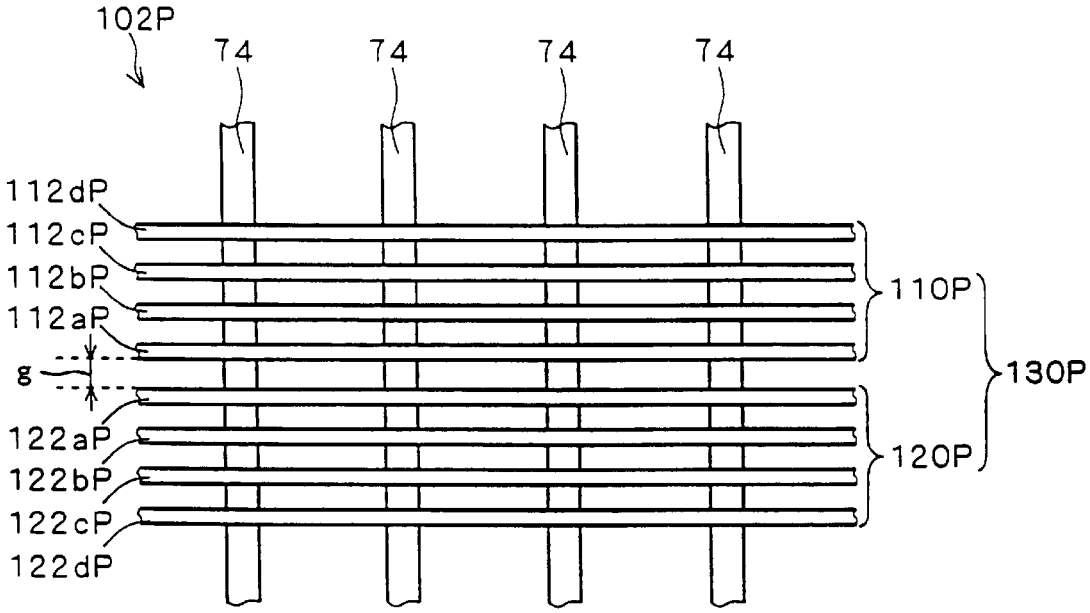
FIG. 31 PRIOR ART
FIG. 31 is a typical top plan view for illustrating the structure of another conventional AC-PDP.

In addition, those overlapping with the barrier ribs 74 in the sustain electrodes 10 and 20 are only the base portions 15 and 25 in the AC-PDP 101. Therefore, light of high luminance (see FIG. 32) emitted from portions close to the barrier ribs 74 can be taken out in a larger quantity than that in the conventional AC-PDP 102P shown in FIG. 31.

As described above, it is understood when referring to FIG. 32 that luminous intensity is increased as approaching the discharge gaps g in the high luminance emitted from portions close to the barrier ribs 74. In consideration of this, the base portions 15 and 25 are formed on positions separated from the discharge gaps g and hence the aforementioned emission of high luminance screened by the thin-line electrodes 112*a*P and 122*a*P and the thin-line electrodes 112*b*P and 122*b*P in the conventional AC-PDP 102P can be effectively taken out.

Further, the projecting portions 16 and 26 have the openings 16K and 26K, and hence emission of high luminance in the vicinity of the discharge gaps in luminance distribution (see FIG. 32) along the first direction D1 can also be effectively taken out.

Thus, the AC-PDP 101 is provided with the projecting portions 16 and 26 and the base portions 15 and 25 not to screen emission of high luminance, whereby the quantity of visible light screened by the sustain electrodes 10 and 20 is smaller than that by the sustain electrodes 110P and 120P of the conventional AC-PDP 102P. Consequently, the AC-PDP 101 is improved in efficiency of taking out visible light and can attain emission of higher luminance than the conventional AC-PDP 102P. In other words, the luminous efficiency can be improved.

Figure 5:
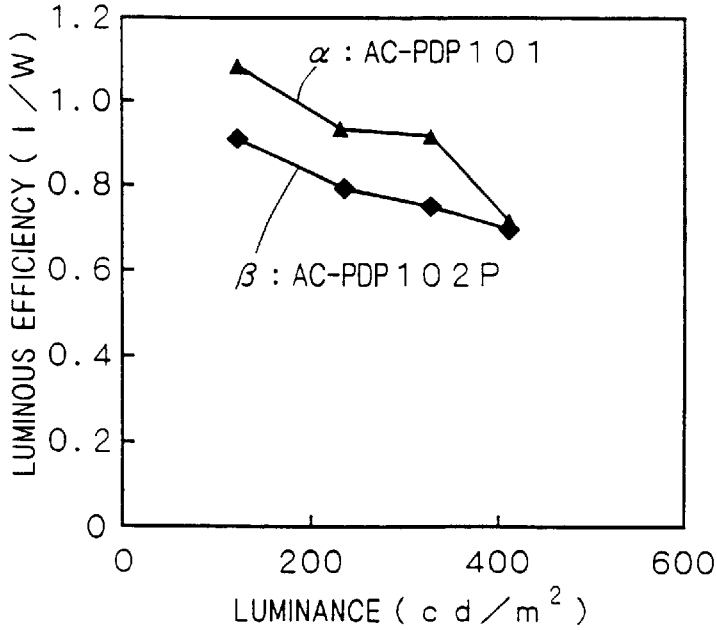
FIG. 5 illustrates the relation between luminance and luminous efficiency of the AC-PDP according to the embodiment 1.

When measuring actual luminous efficiency, such a result has been obtained that luminous efficiency of the AC-PDP 101 (shown by a characteristic curve $\alpha$) is higher than luminous efficiency of the conventional AC-PDP 102P (shown by a characteristic curve $\beta$) by about 20% at the same luminance, as shown in FIG. 5.

In the AC-PDP 101, discharge formed in the discharge gaps g enlarges along the first portions 161 and 261 toward the base portions 15 and 25 or toward the third portions 163 and 263 through (not a plurality of stages of steps but) a single step when the applied voltage is increased. Therefore, the discharge does not spread through a plurality of stages of steps dissimilarly to the case of widening the clearances between the thin-line electrodes 112*a*P to 112*d*P and 122*a*P to 122*d*P in the conventional AC-PDP 102P. According to the AC-PDP 101, therefore, no luminance unevenness resulting from enlargement of discharge through a plurality of stages of steps is observed. Further, a margin of the applied voltage to be set while avoiding a voltage region causing stepwise enlargement of discharge can be widened.

Each of the projecting portions 16 and 26 has two first portions 161 or 261. Also when one of the two first portions 161 or 261 is disconnected, therefore, power can be fed to the second portions 162 and 262 unless the remaining one is disconnected at the same time. In other words, the role of the sustain electrodes 10 and 20 can be ensured. According to the AC-PDP 101 or the front panel 101F, therefore, a highly reliable AC-PDP can be provided with a high yield.

When directly applying Ag paste onto a glass substrate and sintering the same for forming an electrode in general, Ag diffuses into the glass substrate to disadvantageously discolor (yellow) portions of the glass substrate in contact with the electrode and peripheral portions thereof. Such discoloration may take place/progress also in high-temperature treatment after formation of the Ag electrode, e.g., in a step of sintering a dielectric layer corresponding to the dielectric layer 52. Further, it is known that, when ions of an alkaline metal such as Na are present in a glass substrate, discoloration resulting from diffusion of Ag into the glass substrate becomes remarkable.

In the AC-PDP 101, the front panel 101F has the underlayer 55 for remarkably suppressing such discoloration. The underlayer 55 containing no alkaline metal such as Na as described above is remarkably hardly discolored. Further, the underlayer 55 prevents Na ions or the like contained in the glass substrate 51 from diffusing into the sustain electrodes or Ag electrodes 10 and 20, whereby the glass substrate 51 is remarkably hardly discolored as compared with the case of having no underlayer 55. Consequently, unevenness observed since transmittance of discolored portions of the glass substrate 51 is smaller than that of non-discolored portions is invisible in non-display and display of the AC-PDP 101. In other words, no reduction of display quality is induced by the aforementioned discoloration.

<Modification 1 of Embodiment 1>

Figure 6:
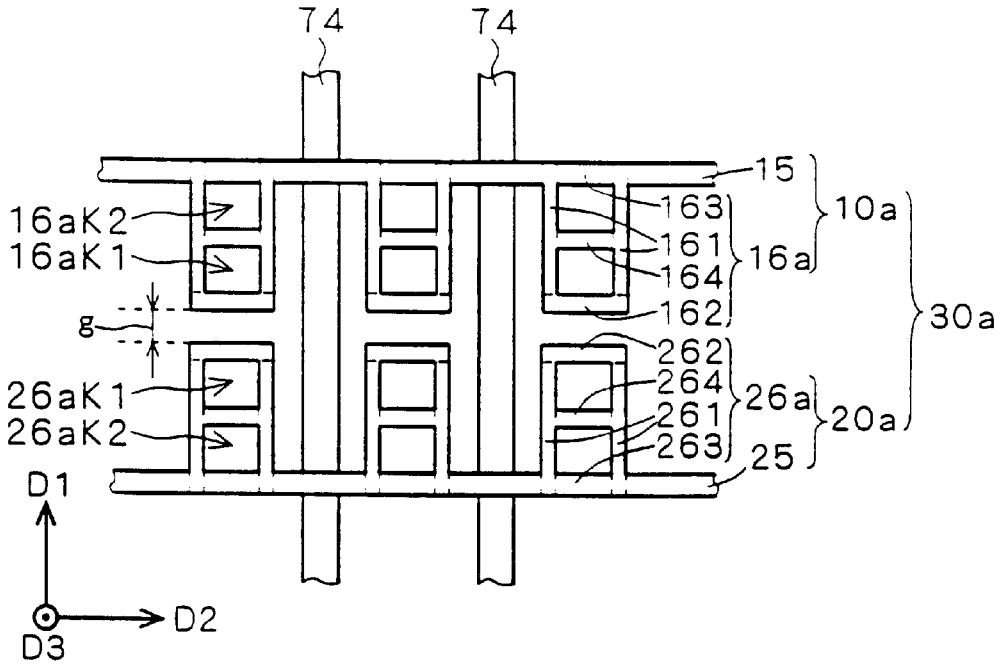
FIG. 6 is a typical top plan view for illustrating an electrode structure of an AC-PDP according to a modification 1 of the embodiment 1.

Each of the aforementioned sustain electrode pairs 30 may be replaced with a sustain electrode pair 30*a* consisting of sustain electrodes 10*a* and 20*a* shown in FIG. 6. As shown in FIG. 6, the sustain electrodes 10*a* and 20*a* are formed by (i) the aforementioned base portions 15 and 25 and (ii) projecting portions 16*a* and 26*a* consisting of fourth portions 164 and 264 in addition to the aforementioned first to third portions 161 and 261 to 163 and 263.

The fourth portion 164 is coupled with ends of the first portions 161 along a second direction D2 for connecting two first portions 161 with each other. In this case, the two first portions 161, the second portion 162 and the fourth portion 164 define an opening 16*a*K1, while the two first portions 161, the third portion 163 and the fourth portion 164 define another opening 16*a*K2. On the other hand, the fourth portion 264 is arranged similarly to the aforementioned fourth portion 164, for defining openings 26*a*K1 and 26*a*K2 similar to the openings 16*a*K1 and 16*a*K2 respectively.

While the fourth portions 164 and 264 are coupled substantially at the centers of the ends of the first portions 161 and 261 in the second direction D2 and formed along the second direction D2 in FIG. 6, the fourth portions 164 and/or 264 may alternatively be formed on portions closer to the first portions 161 and 261 or the third portions 163 and 263 or inclined with respect to the second direction D2.

The projecting portions 16*a*and 16*a*, larger in electrode area than the projecting portions 16 and 26 due to the fourth portions 164 and 264, can supply a larger quantity of discharge current for increasing discharge. Thus, luminous intensity can be increased. The electrode area of each projecting portion is (a) the area of the projecting portion itself or (b) the total area of the projecting portion plus a portion (or range) where the electric field exudes from the projecting portion.

<Modification 2 of Embodiment 1>

The aforementioned sustain electrodes 10 and 20 and sustain electrodes 10*a* and 20*a* have the openings 16K and 26K and the openings 16*a*K1, 16*a*K2, 26*a*K1 and 26*a*K2 respectively. When patterning such opening shapes with the aforementioned photosensitive Ag paste, development residues may remain in the openings. This is because, with respect to penetration of a developer from a side surface direction (the direction perpendicular to the third direction D3) to the Ag paste after exposure, the penetration in the openings 16K and 26K is smaller than that with respect to end portions of the first portions 161 and 261 of the opposite side of openings 16K and 26K, for example.

Figure 7:
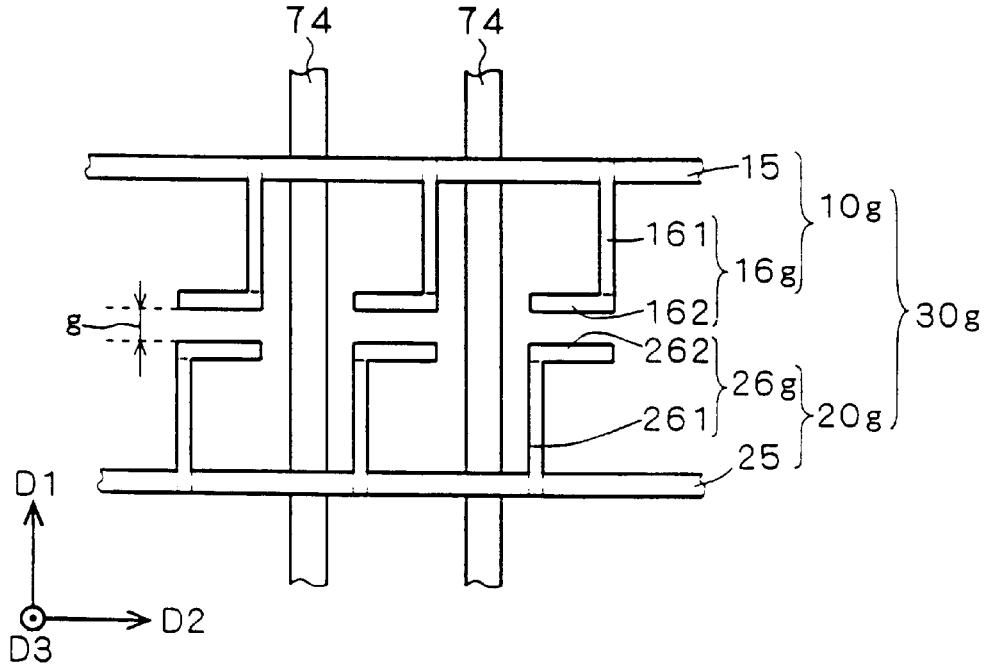
FIG. 7 is a typical top plan view for illustrating an electrode structure of an AC-PDP according to a modification 2 of the embodiment 1.

On the other hand, sustain electrodes 10*g* and 20*g* forming a sustain electrode pair 30*g* according to a modification 2 of the embodiment 1 can reduce the aforementioned development residues. As shown in a top plan view of FIG. 7, projecting portions 16*g* and 26*g* of the sustain electrodes 10*g* and 20*g* are L-shaped. More specifically, each of the projecting portions 16*g* and 26*g* has only a single first portion 161 or 261, dissimilarly to the projecting portions 16 and 26 shown in FIG. 1. In particular, the first portions 161 and 261 of the projecting portions 16*g* and 26*g* are located on rotation-symmetrical positions through (the center of) a discharge gap g.

The sustain electrodes 10*g* and 20*g*, having no openings such as the openings 16K and 26K, hardly cause the aforementioned development residues but are easy to develop.

In the sustain electrodes 10 and 20 etc., the opening shapes must be designed to sizes exceeding a certain degree for excellently pattern-forming the openings 16K, 26K etc., and the sizes of such opening shapes must be taken into consideration for miniaturizing the light emitting cells, i.e., progressing improvement in definition of the AC-PDP. On the other hand, the sustain electrodes 10*g* and 20*g* are more suitable for improvement in definition of the AC-PDP as compared with the sustain electrodes 10 and 20 etc. since the same have no opening shapes but are easy to develop.

Further, the first portions 161 and 261 of the projecting portions 16*g* and 26*g* are located on the rotation-symmetrical positions through (the center of) the discharge gap g, as hereinabove described. Even if misalignment is caused between a front panel 101F and a rear panel 101RP along a second direction D2, therefore, only one of the first portions 161 and 261 screens high-luminance emission in the vicinity of the aforementioned barrier ribs 74. Therefore, such an effect is attained that reduction of luminance resulting from the aforementioned misalignment may be smaller as compared with the sustain electrodes 10 and 20.

The first portions 161 and 261 of the projecting portions 16*g* and 26*g* may alternatively be arranged line-symmetrical with respect to the discharge gap g (in relation to a symmetry line (not shown) parallel to the second direction D2). According to such arrangement, it is possible to, when misalignment is caused between the front panel 101F and the rear panel 101RP in such a direction that the first portions 161 and 261 separate from the barrier ribs 74, remarkably reduce reduction of luminance resulting from this misalignment. When the first portions 161 and 261 are arranged on the aforementioned rotation-symmetrical positions, discharge or emission is not biased to one barrier rib 74 in each discharge cell, preferably on display quality.

Figure 8:
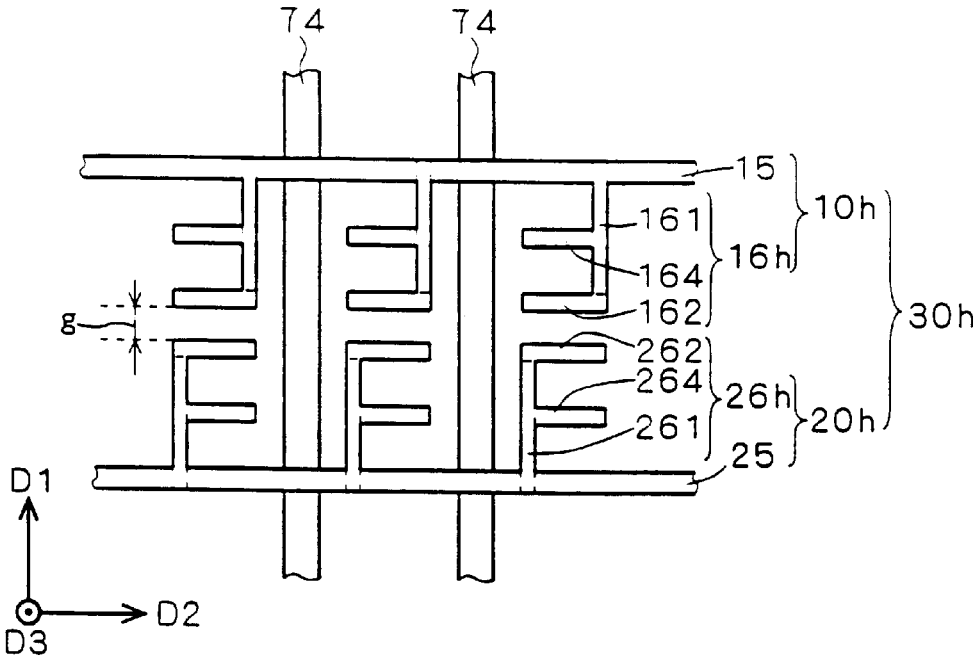
FIG. 8 is a typical top plan view for illustrating another electrode structure of the AC-PDP according to the modification 2 of the embodiment 1.

FIG. 8 shows other sustain electrodes 10h and 20*h* according to the modification 2. The sustain electrodes 10*h* and 20*h* can also attain an effect similar to that of the aforementioned sustain electrodes 10*g* and 20*g*. As shown in FIG. 8, projecting portions 16*h* and 26*h* of the sustain electrodes 10*h* and 20*h* forming a sustain electrode pair 30*h* are F-shaped (hence including L-shapes). More specifically, each of the projecting portions 16*h* and 26*h* has only a single first portion 161 or 261 with respect to the projecting portions 16*a* and 26*a* (see FIG. 6). Similarly to the aforementioned sustain electrodes 10*g* and 20*g*, the first portions 161 and 261 of the projecting portions 16*h* and 26*h* are located on rotation-symmetrical positions through (the center of) a discharge gap g.

<Modification 3 of Embodiment 1>

Figure 9:
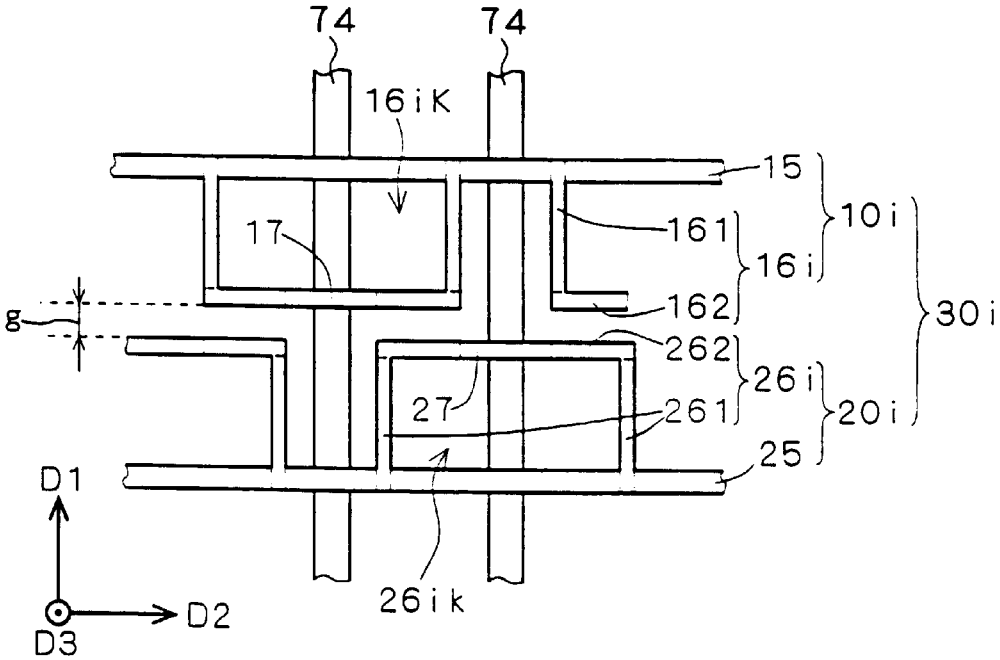
FIG. 9 is a typical top plan view for illustrating an electrode structure of an AC-PDP according to a modification 3 of the embodiment 1.

FIG. 9 shows sustain electrodes 10*i* and 20*i* according to a modification 3 of the embodiment 1. As shown in FIG. 9, pairs of projecting portions 16*i* and 26*i* adjacent to each other along a second direction D2 and coupling portions 17 and 27 form U shapes extending over barrier ribs 74 in the sustain electrodes 10*i* and 20*i* forming a sustain electrode pair 30*i*.

More specifically, the projecting portions 16*i* are L-shaped similarly to the aforementioned sustain electrode 10*g* (see FIG. 7), while first portions 161 of the two projecting portions 16*i* adjacent in the second direction D2 are located on line-symmetrical positions about each barrier rib 74, dissimilarly to the aforementioned sustain electrode 10*g*. Ends of second portions 162 of the two projecting portions 16*i* adjacent along the second direction D2 not coupled with the first portions 161 are coupled through the coupling portion 17 extending in the second direction D2 over the barrier rib 74. The aforementioned adjacent projecting portions 16*i*, the coupling portion 17 and a base portion 15 define an opening 16*i* K. Similarly, second portions 262 of two projecting portions 26*i* adjacent along the second direction D2 are also coupled through the coupling portion 27 similar to the aforementioned coupling portion 17, to define an opening 26*i*K similar to the aforementioned opening 16*i*K.

Similarly to the aforementioned sustain electrodes 10*g* and 20*g* (see FIG. 7), the first portions 161 and 261 in the same discharge cell are located on rotation-symmetrical positions through (the center of) a discharge gap g.

The sustain electrodes 10*i* and 20*i* can also attain an effect similar to that of the aforementioned sustain electrodes 10*g* and 20*g* due to the projecting portions 16*i* and 26*i*. In particular, the openings 16*i*K and 26*i*K of the sustain electrodes 10*i* and 20*i* are larger than the aforementioned openings 16K and 26K (see FIG. 1), whereby the sustain electrodes 10*i* and 20*i* more hardly cause development residues than the sustain electrodes 10 and 20.

<Embodiment 2>

Figure 10:
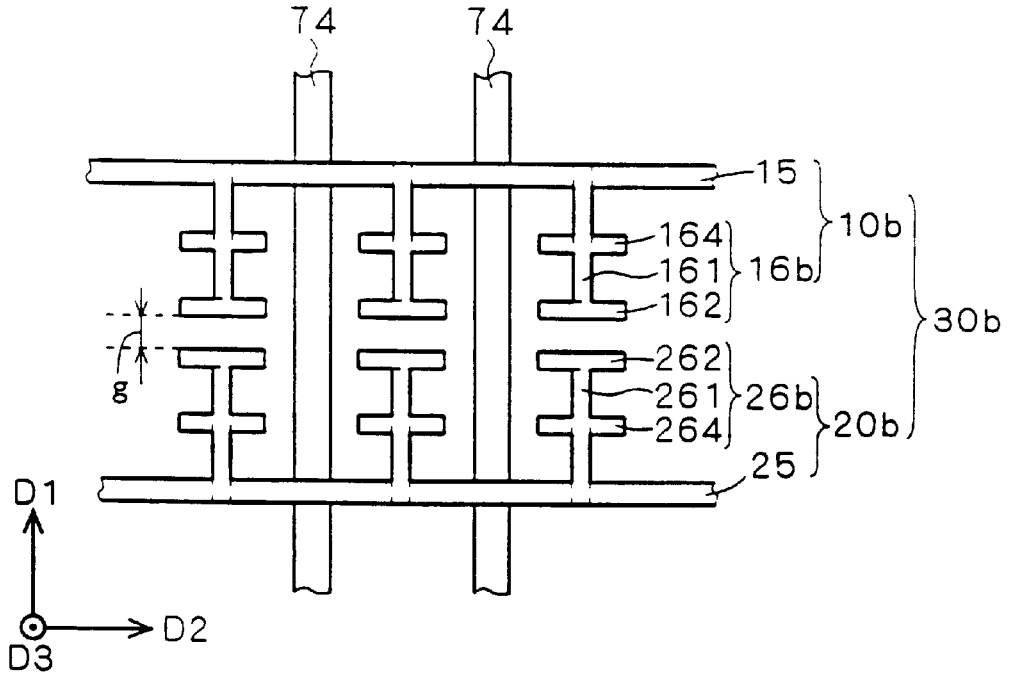
FIG. 10 is a typical top plan view for illustrating an electrode structure of an AC-PDP according to an embodiment 2 of the present invention.

The aforementioned sustain electrode pair 30 may be replaced with a sustain electrode pair 30*b* formed by sustain electrodes 10*b* and 20*b* shown in FIG. 10. As understood by comparing FIG. 10 with the FIG. 6, the sustain electrodes 10*b* and 20*b* comprise (i) the aforementioned base portions 15 and 25 and (ii) projecting portions 16*b* and 26*b* having the following structure: Each of the projecting portions 16*b* and 26*b* has no third portion 163 or 263 but comprises only a single first portion 161 or 261, dissimilarly to the aforementioned sustain electrodes 10*a* and 20*a*. The first portions 161 and 261 intersect with fourth portions 164 and 264, and share the intersections with the fourth portions 164 and 264.

While the aforementioned single first portions 161 and 261 are arranged substantially at central portions between adjacent barrier ribs 74 and coupled with substantially central portions of ends of second portions 162 and 262 in a first direction D1 in FIG. 10, the first portions 161 and 261 may alternatively be inclined with respect to the first direction D1. The projecting portions 16*b* and 26*b* may be in T shapes (graspable also as combinational shapes of pairs of L shapes) having no fourth portions 164 and 264. The first portions 161 and 261 of the projecting portions 16*b* and 26*b* are separated from the barrier ribs 74 by at least 70 $\mu$m.

The sustain electrodes 10*b* and 20*b* can attain the following effects:

The sustain electrodes 10*b* and 20*b* have only single first portions 161 and 261, whereby efficiency of taking out visible light can be increased for improving luminous intensity as compared with the aforementioned AC-PDP 101 or an AC-PDP having the aforementioned sustain electrode pair 30*a*.

Also when a front panel 101F and a rear panel 101RP are misaligned, reduction of luminance resulting from the aforementioned misalignment is remarkably smaller according to the sustain electrodes 10*b* and 20*b* as compared with the sustain electrodes 10 and 20.

The sustain electrodes 10 have the two first portions 161, whereby one of the first portions 161 approaches the barrier ribs 74 to screen high-luminance emission in the vicinity of the barrier ribs 74 when the front panel 101F and the rear panel 101RP relatively deviate in the second direction D2, for example. This also applies to the sustain electrode 20.

On the other hand, the sustain electrodes 10*b* and 20*b* have only single first portions 161 and 261, while the first portions 161 and 261 are arranged substantially at the central portions between the adjacent barrier ribs 74. Also when the aforementioned misalignment takes place, therefore, the deviating first portions 161 and 261 hardly screen high-luminance emission in the vicinity of the barrier ribs 74. Also when deviating second portions 162 and 262 and fourth portions 164 and 264 screen the aforementioned high-luminance emission, screened regions are only parts of high luminance emission regions, dissimilarly to the first portions 161 and 261. Therefore, the quantity of light screened by the sustain electrodes 10*b* and 20*b* due to the aforementioned misalignment, i.e., reduction of luminance is remarkably smaller as compared with the sustain electrodes 10 and 20.

Further, the sustain electrodes 10*b* and 20*b* have no openings, whereby electrode patterns are easier to form as compared with the sustain electrodes 10 and 20 and suitable for improvement in definition.

When forming electrode patterns with photosensitive Ag paste, for example, the width (the size along the second direction D2) of the first portions 161 and 261 is about 30 $\mu$m at the minimum. In the case of the sustain electrodes 10 and 20, the openings 16K and 26K must be at least 60 $\mu$m along the second direction D2, in order to accurately form the openings 16K and 26K. When also considering the point that the first portions 161 and 261 are separated from the barrier ribs 74 by at least 70 $\mu$m, the distance between the side surfaces of the adjacent barrier ribs 74 in the case of the sustain electrodes 10 and 20 is at least:

$$30\times2+60+70\times2=260(\mu m)$$

In the sustain electrodes 10*b* and 20*b*, on the other hand, the distance between side surfaces of the adjacent barrier ribs 74 may be:

$$30+70\times2=170\ (\mu m)$$

Thus, the sustain electrodes 10*b* and 20*b* are more suitable to the case where the pitch of discharge cells along the second direction D2 is narrow, i.e., improvement in definition. Improvement in definition from such a point of view is appropriate also with respect to the aforementioned sustain electrodes 10*g* and 20*g* and the sustain electrodes 10*h* and 20*h* having only single first portions 161 and 261 similarly to the sustain electrodes 10*b* and 20*b*.

The projecting portions 16*b* and 26*b*, having the single first portions 161 and 261, are smaller in electrode area as compared with the projecting portions 16 and 26. Therefore, discharge current, i.e., a load on a driving circuit may advantageously be small. When requiring emission of higher luminance at the same driving frequency, it is preferable to employ the sustain electrodes 10 and 20 having larger electrode areas. The distance between the first portions 161 and 261 and the fluorescent layers on the side surfaces of the barrier ribs 74 is smaller in the sustain electrodes 10 and 20. In consideration of the fact that the discharge current concentrates to electrode positions, it is preferable to employ the sustain electrodes 10 and 20 when requiring a larger quantity of arrival of ultraviolet rays generated in discharge at the fluorescent layers.

<Embodiment 3>

Figure 11:
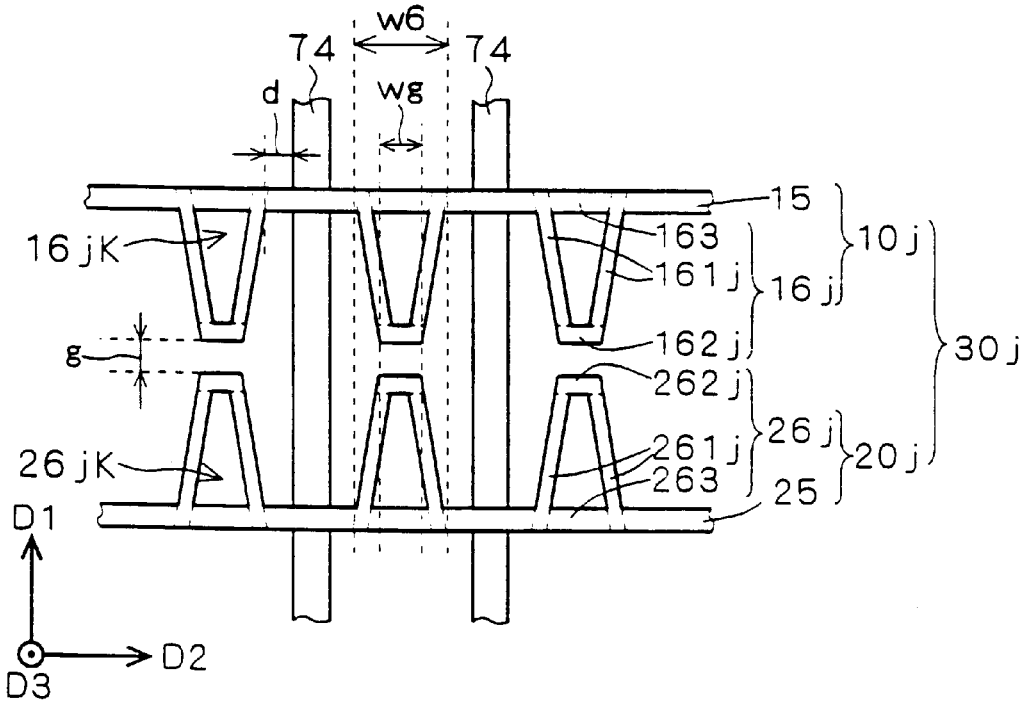
FIG. 11 is a typical top plan view for illustrating an electrode structure of an AC-PDP according to an embodiment 3 of the present invention.

FIG. 11 is a typical top plan view for illustrating sustain electrodes 10*j* and 20*j* forming a sustain electrode pair 30*j* according to an embodiment 3 of the present invention. The sustain electrodes 10*j* and 20*j* comprise the aforementioned base portions 15 and 25 and projecting portions 16*j* and 26*j* described below. The projecting portions 16*j* and 26*j* have openings 16*j*K and 26*j*K similar to the openings 16K and 26K shown in FIG. 1 respectively.

As understood by comparing FIG. 11 with the aforementioned FIG. 1, the length wg of second portions (corresponding to discharge-gap-forming-portions themselves) 162*j* and 262*j* of the projecting portions 16*j* and 26*j* along a second direction D2 is smaller than that of the second portions 162 and 262 of the projecting portions 16 and 26. On the other hand, the lengths of the third portions 163 and 263 along the second direction D2 are equally set in both of the projecting portions 16*j* and 26*j* and the projecting portions 16 and 26.

The aforementioned length wg of the second portions 162*j* and 262*j* is smaller than the length w6 of the remaining portions of the projecting portions 16*j* and 26*j* other than the second portions 162*j* and 262*j* along the direction (the second direction D2) perpendicular to the projecting direction (the first direction D1) of the projection portions 16*j* and 26*j*. Therefore, the third portions 163 and 263 are longer than the second portions 162*j* and 262*j*, and the first portions 161*j* and 261*j* of the sustain electrodes 10*j* and 20*j* extend in a direction inclined with respect to the first direction D1. The minimum value of the space or the distance d between the first portions 161*j* and 261*j* and the barrier ribs 74 is set to at least about 70 $\mu$m.

When the sizes of the discharge gaps g of the sustain electrode pair 30*j* and the sustain electrode pair 30 (along the first direction D1) are equal to each other, the sustain electrode pair 30*j* has a smaller maximum field applied to a discharge space due to the difference between the lengths of the second portions. Therefore, a firing voltage Vf for the sustain electrode pair 30*j* is higher as compared with that for the sustain electrode pair 30.

According to the sustain electrodes 10*j* and 20*j*, the distance between the second portions 162*j* and 262*j* and the barrier ribs 74 is large due to the small length of the second portions 162*j* and 262*j*, whereby a wide allowance can be attained for misalignment of the front panel 101F and the rear panel 101RP. When a sustain voltage Vs is reduced, there appears a limit voltage Vs0 capable of sustaining discharge. When the distance between the second portions and the barrier ribs 74 falls below a certain value due to misalignment of the front panel 101F and the rear panel 101RP or the like, the aforementioned voltage Vs0 tends to increase following reduction of the distance. Considering that a driving voltage margin corresponds to a range between the minimum value of the firing voltage Vf and the maximum value of the aforementioned voltage Vs0 on the basis of the voltage Vs0 and dispersion of discharge characteristics of respective discharge cells, the driving voltage margin is disadvantageously narrowed to unstabilize operations when a discharge cell having a high voltage Vs0 is present in the AC-PDP. In this case, the yield is reduced in view of manufacturing. According to the sustain electrodes 10*j* and 20*j*, however, a wide allowance can be attained for misalignment as described above, and hence an AC-PDP capable of stable operations can be manufactured with an excellent yield as compared with the sustain electrodes 10 and 20.

Due to the difference between the lengths of the second portions, further, the electrode area of the projecting portions 16*j* and 26*j*, i.e., the area screened by the projecting portions 16*j* and 26*j* or the sustain electrodes 10*j* and 20*j* is smaller than that of the projecting portions 16 and 26. In other words, the numerical aperture of the former is larger than that of the latter. In particular, the projecting portions 16*j* and 26*j* have a larger numerical aperture around the discharge gap g as compared with the projecting portions 16 and 26, whereby high luminance emission (see FIG. 32) around the discharge gap g can be more efficiently utilized for attaining high luminance.

Further, the third portions 163 and 263 are longer than the second portions 162*j* and 262*j* as described above, whereby discharge can be spread for improving luminous efficiency dissimilarly to the case where the third portions 163 and 263 are equivalent to the second portions 162*j* and 262*j*.

<Modification 1 of Embodiment 3>

Figure 12:
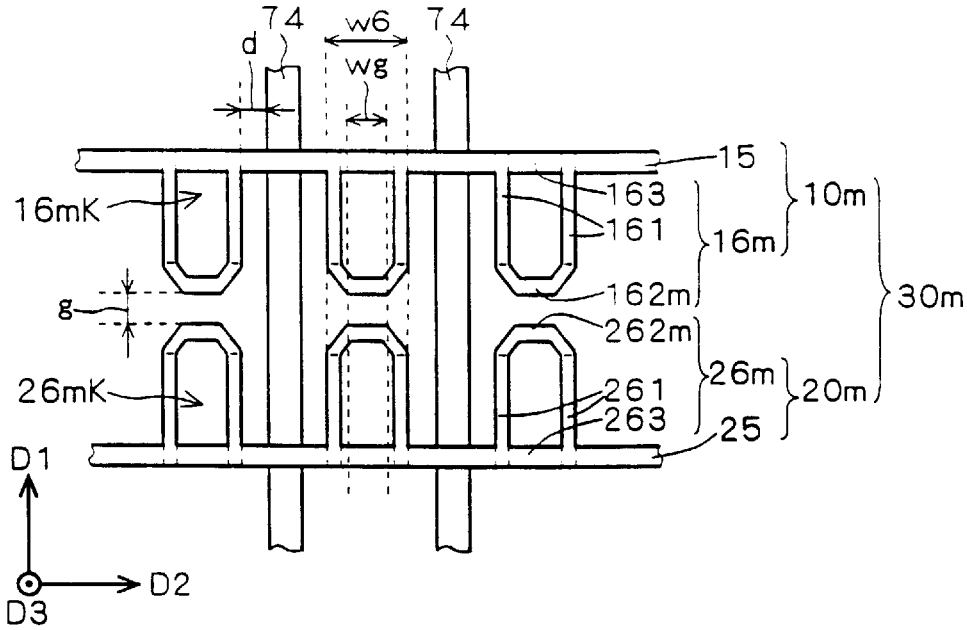
FIG. 12 is a typical top plan view for illustrating an electrode structure of an AC-PDP according to a modification 1 of the embodiment 3.

FIG. 12 is a typical top plan view for illustrating sustain electrodes 10*m* and 20*m* forming a sustain electrode pair 30*m* according to a modification 1 of the embodiment 3. The sustain electrodes 10*m* and 20*m* comprise the aforementioned base portions 15 and 25 and projecting portions 16*m* and 26*m* described below. The projecting portions 16*m* and 26*m* have openings 16*m*K and 26*m*K similar to the openings 16K and 26K shown in FIG. 1 respectively.

The projecting portions 16*m* and 26*m* of the sustain electrodes 10*m* and 20*m* comprise first portions 161 and 261 and third portions 163 and 263 similar to those of the sustain electrodes 10 and 20 and second portions 162*m* and 262*m*. The second portions 162*m* and 262*m* of the projecting portions 16*m* and 26*m* are formed by (i) discharge-gap-forming-portions facing the discharge gap g to form a discharge gap g and (ii) coupling portions electrically coupling the discharge-gap-forming-portions with the first portions 161 and 261.

More specifically, the discharge-gap-forming-portions correspond to the aforementioned second portions 162*j* and 262*j* (see FIG. 11), and the length thereof along a second direction D2 is equivalent to that of the aforementioned second portions 162*j* and 262*j*. The coupling portions extend in a direction inclined with respect to a first direction D1, so that the second portions 162*m* and 262*m* and the first portions 161 and 261 define substantially U shapes. In this case, the length wg of the discharge-gap-forming-portions along the second direction D2 is smaller than the length w6 of the remaining portions of the projecting portions 16*m* and 26*m* other than the discharge-gap-forming-portions along the second direction D2.

According to the sustain electrodes 10*m* and 20*m*, the discharge-gap-forming-portions of the second portions 162*m* and 262*m* are similar to the aforementioned second portions 162*j* and 262*j*, whereby an effect similar to that of the sustain electrodes 10*j* and 20*j* can be attained.

Further, the sustain electrodes 10*m* and 20*m* can attain the following effects: First, the first portions 161 and 261 of the sustain electrodes 10*m* and 20*m*, extending along the first direction D1, are closer to barrier ribs 74, i.e., to fluorescent layers on side surfaces of the barrier ribs 74, as compared with the sustain electrodes 10*j* and 20*j*. Therefore, the sustain electrodes 10*m* and 20*m* can more improve luminous efficiency as compared with the sustain electrodes 10*j* and 20*j*.

In addition, the openings 16*m*K and 26*m*K of the projecting portions 161*m* and 261*m* open toward the second portions more widely as compared with the openings 16*j*K and 26*j*K of the projecting portions 16*j* and 26*j*. Therefore, when forming electrode patterns with photosensitive Ag paste, for example, the sustain electrodes 10*m* and 20*m* hardly cause development residues as compared with the sustain electrodes 10*j* and 20*j*.

<Modification 2 of Embodiment 3>

Figure 13:
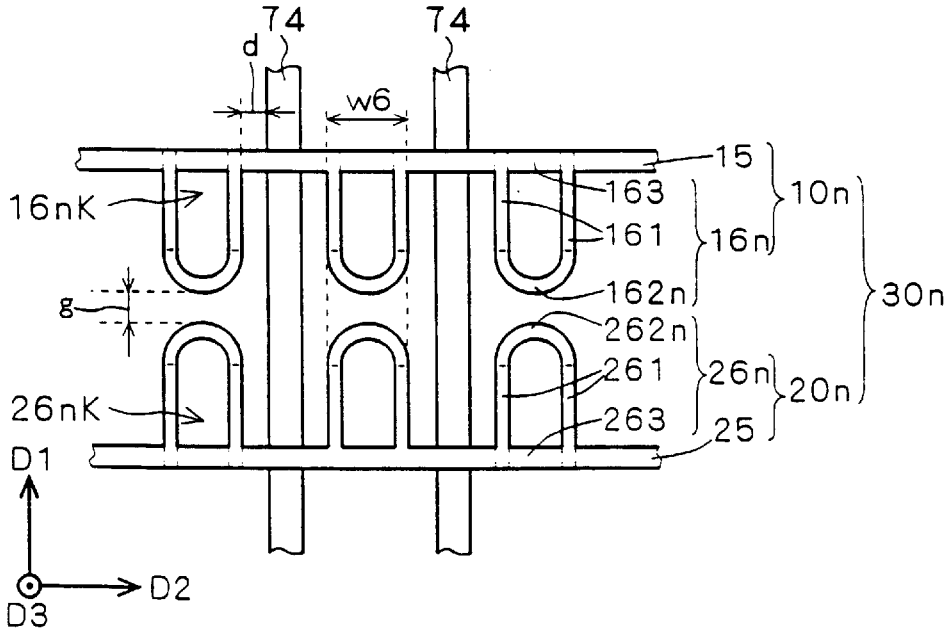
FIG. 13 is a typical top plan view for illustrating an electrode structure of an AC-PDP according to a modification 2 of the embodiment 3.

FIG. 13 is a typical plan view for illustrating sustain electrodes 10*n* and 20*n* forming a sustain electrode pair 30*n* according to a modification 2 of the embodiment 3. Comparing FIG. 13 with the aforementioned FIG. 12, it is understood that the second portions 162*n* and 262*n* of projecting portions 16*n* and 26*n* of the sustain electrodes 10*n* and 20*n* have shapes defined by rounding the second portions 162*m* and 262*m* of FIG. 12, so that first portions 161 and 261 and the second portions 162*n* and 262*n* define U shapes. More specifically, the projection portions 16*n* and 26*n* are formed by (i) the first portions 161 and 261 of the sustain electrodes 10*m* and 20*m* and (ii) semi-arcuate second portions 162*n* and 262*n* having centers in openings 16*n*K and 26*n*K of the projecting portions 16*n* and 26*n*.

In this case, portions around the tops of the semi-arcuate portions correspond to discharge-gap-forming-portions of the second portions 162*n* and 262*n* facing each other to form a discharge gap g, and the length of the discharge-gap-forming-portions is smaller than the length w6 of the remaining portions of the projecting portions 16*n* and 26*n* other than the discharge-gap-forming-portions along a second direction D2.

The sustain electrodes 10*n* and 20*n* can also attain effects similar to those of the aforementioned sustain electrodes 10*m* and 20*m*.

<Modification 3 of Embodiment 3>

Figure 14:
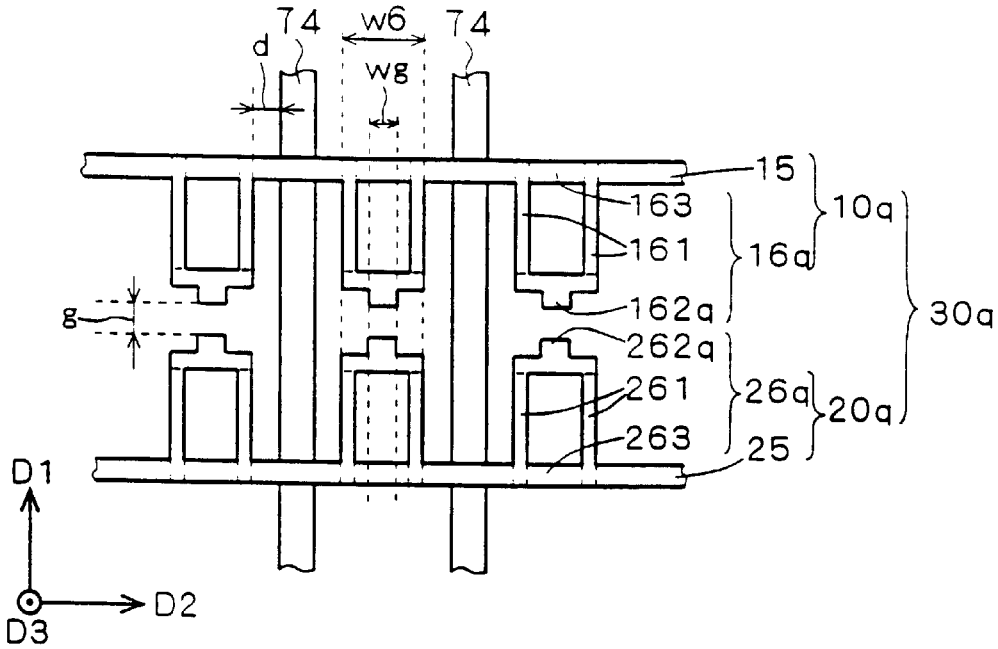
FIG. 14 is a typical top plan view for illustrating an electrode structure of an AC-PDP according to a modification 3 of the embodiment 3.

FIG. 14 is a typical top plan view for illustrating sustain electrodes 10*q* and 20*q* forming a sustain electrode pair 30*q* according to a modification 3 of the embodiment 3. The sustain electrodes 10*q* and 20*q* comprise the aforementioned base portions 15 and 25 and projecting portions 16*q* and 26*q* described below.

Comparing FIG. 14 with FIG. 1, it is understood that second portions 162*q* and 262*q* of the sustain electrodes 10*q* and 20*q* are T-shaped so that portions corresponding to arms of the Ts (hereinafter referred to as "body portions (of T shapes)") are coupled with first portions 161 and 261 and portions corresponding to stems of the Ts (hereinafter referred to as "legs (of T shapes)") project toward the facing sustain electrodes 20*q* and 10*q*. Ends of the legs, defining a discharge gap g, correspond to discharge-gap-forming-portions. The length wg of the legs of the second portions 162*q* and 262*q* along a second direction D2 is set substantially identically to the length wg of the second portions 162*j* and 262*j* shown in FIG. 11, for example. In this case, the aforementioned length wg is smaller than the length w6 of the remaining portions of the projecting portions 16*q* and 26*q* other than the legs along the second direction D2 due to the shapes of the second portions 162*q* and 262*q*.

When the electrode area or the numerical aperture of the projecting portions 16*q* and 26*q* is identical to that of the projecting portions 16 and 26 shown in FIG. 1, the projecting portions 16*q* and 26*q* have a larger numerical aperture in the vicinity of the discharge gap g due to the difference between the shapes of the second portions. Therefore, the sustain electrodes 10*q* and 20*q* can more effectively utilize high luminance emission (see FIG. 32) around the discharge gap g for improving luminance.

<Modification 4 of Embodiment 3>

Figure 15:
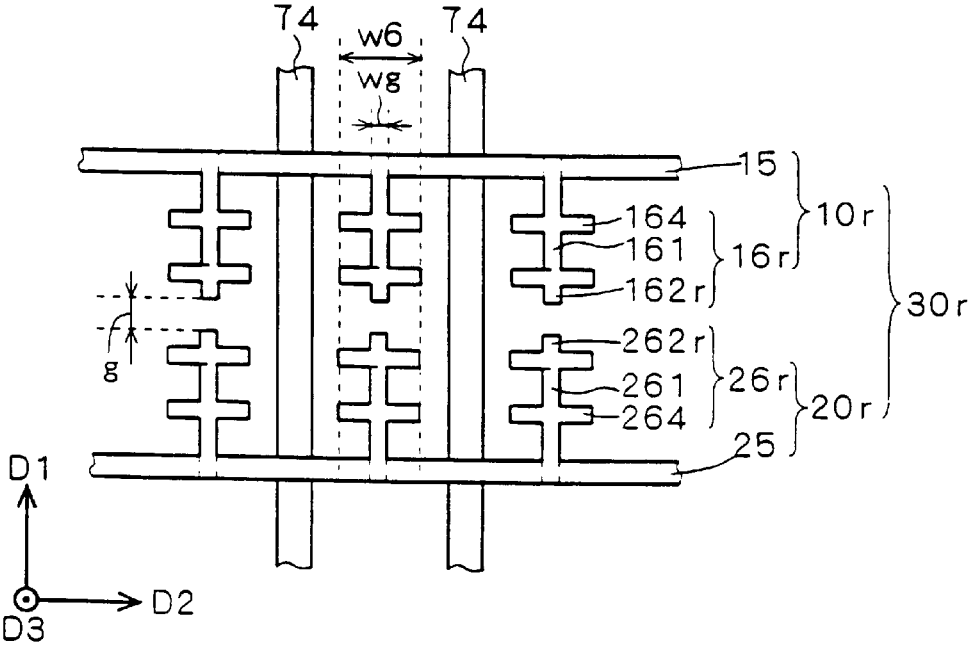
FIG. 15 is a typical top plan view for illustrating an electrode structure of an AC-PDP according to a modification 4 of the embodiment 3.

FIG. 15 is a typical top plan view for illustrating sustain electrodes 10*r* and 20*r* forming a sustain electrode pair 30r according to a modification 4 of the embodiment 3. The sustain electrodes 10*r* and 20*r* correspond to such shapes that the second portions 162 and 262 and the fourth portions 164 and 264 of the sustain electrodes 10*b* and 20*b* shown in FIG. 10 deviate toward the base portions 15 and 25.

More specifically, second portions 162*r* and 262*r* of the projecting portions 10*r* and 20*r* are T-shaped similarly to the second portions 162*q* and 262*q* shown in FIG. 14, so that legs (discharge-gap-forming-portions) of the second portions 162*r* and 262*r* form a discharge gap g and body portions thereof are coupled with first portions 161 and 262. In this case, the length wg of the legs of the second portions 162*r* and 262*r* along a second direction D2 is smaller than the length w6 of the remaining portions of the projecting portions 16*r* and 26*r* other than the aforementioned legs (more specifically, the body portions of the second portions 162*r* and 262*r* and fourth portions 164 and 264) along the second direction D2.

While the aforementioned length wg is identical to the width (the length along the second direction D2) of the first portions 161 and 261 in FIG. 15, the length wg may alternatively be set larger than the width of the first portions 161 and 261.

The sustain electrodes 10*r* and 20*r* can more effectively utilize high luminance emission (see FIG. 32) in the vicinity of the discharge gap g than the sustain electrodes 10*b* and 20*b* for improving luminance due to reasons similar to those in the aforementioned sustain electrodes 10*q* and 20*q*. Further, the sustain electrodes 10*r* and 20*r* can attain effects similar to those of the aforementioned sustain electrodes 10*b* and 20*b* such that reduction of luminance resulting misalignment of a front panel 101F and a rear panel 101RP can be suppressed, electrode patterns are easy to form etc., as a matter of course.

<Embodiment 4>

As hereinabove described, the sustain electrodes 10 and 20 etc. have the openings 16K and 26K etc. and hence development residues may result in such openings 16K and 26K etc. when patterning the openings 16K and 26K with the aforementioned photosensitive Ag paste.

When having forward end portions, such as the second portions 162 and 262 and the fourth portions 164 and 264 of the sustain electrodes 10*b* and 20*b* shown in FIG. 10, not coupled with other portions or interrupted and isolated, pattern may be peeled on such forward portions when developing the aforementioned photosensitive Ag paste. This is because the developer can penetrate the aforementioned forward end portions from both of the first and second directions D1 and D2 and hence etching excessively progresses on exposed portions, particularly portions close to the glass substrate 51 along the thickness direction.

Such development residues or peelings of the patterns can take place also when patterning the sustain electrodes 10 and 20 etc. with Ag paste having no photosensitivity and resist.

While the aforementioned development residues can be reduced by increasing the development time, pattern peelings disadvantageously takes place in portions other than the openings when the development time is too long. When setting the development time not to peel the aforementioned isolated forward end portions, on the other hand, the remaining portions may be insufficiently patterned.

Figure 16:
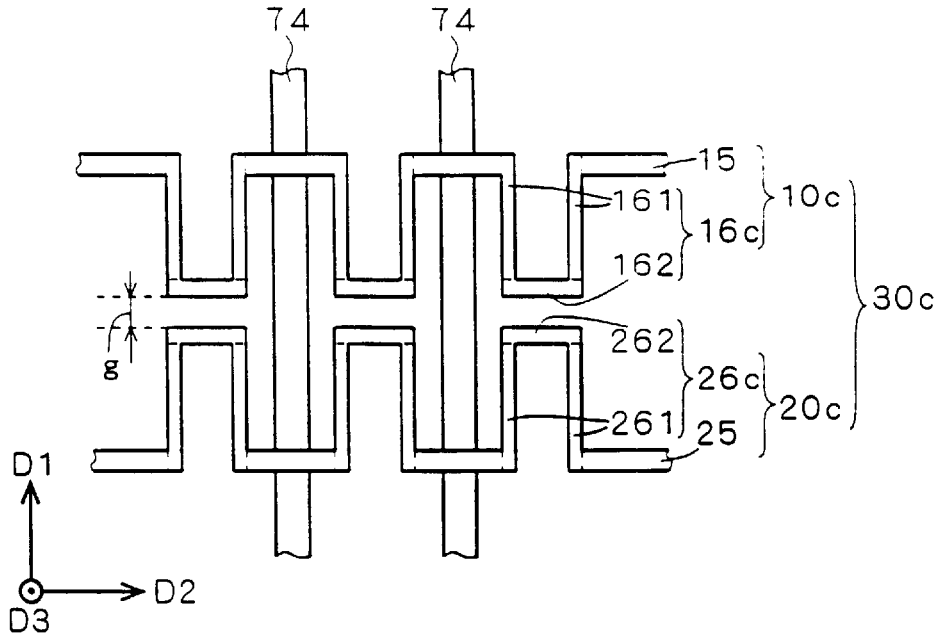
FIG. 16 is a typical top plan view for illustrating an electrode structure of an AC-PDP according to an embodiment 4 of the present invention.

Sustain electrodes 10*c* and 20*c* according to an embodiment 4 of the present invention shown in FIG. 16 can reduce the aforementioned development residues or peelings. As shown in FIG. 16, the sustain electrodes 10*c* and 20*c* forming a sustain electrode pair 30*c* are formed by (i) the aforementioned base portions 15 and 25 and (ii) structures obtained by removing the third portions 163 and 263 from the aforementioned projections 16 and 26 (see FIG. 1), i.e., U-shaped projecting portions 16*c* and 26*c*. The sustain electrodes 10*c* and 20*c* have none of the aforementioned opening shapes and isolated forward end portions, whereby pattern formation can be reliably performed while reducing development residues or peelings of Ag paste. In other words, a margin of the development time defined by a time (lower limit) necessary for performing patterning in a proper shape and a time (upper limit) causing peelings can be more widened and hence a sustain electrode forming step can be reliably executed.

Figure 17:
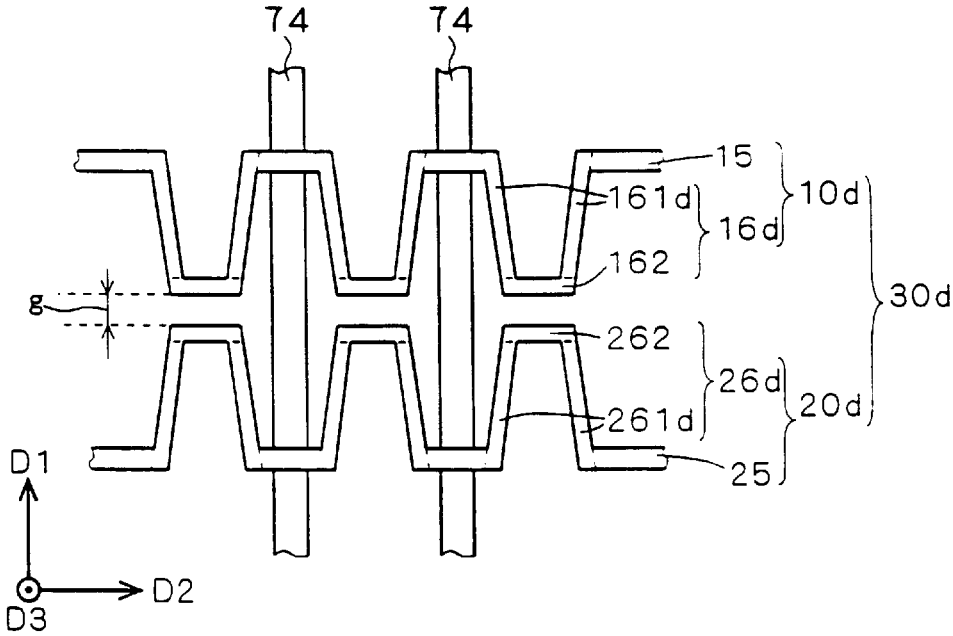
FIG. 17 is a typical top plan view for illustrating another electrode structure of the AC-PDP according to the embodiment 4.

FIG. 17 shows another electrode structure to the embodiment 4. As shown in FIG. 17, sustain electrodes 10*d* (15, 16*d*) and 20d (25, 26*d*) forming a sustain electrode pair 30*d* have first portions 161*d* and 261*d* extending in a direction inclined with respect to a first direction D1, in place of the first portions 161 and 261 shown in FIG. 16. The sustain electrodes 10*d* and 20*d* can attain effects similar to those of the aforementioned sustain electrodes 10*c* and 20*c*. While the angle formed by base portions 15 and 25 and the first portions 161*d* and 261*d* and that formed by the first portions 161*d* and 261*d* and second portions 162 and 262 are greater than 90° in FIG. 17, these angles may alternatively be smaller than 90°.

<Embodiment 5>

In the conventional AC-PDPs 101P and 102P, the balance of luminous intensity of red, green and blue is adjusted for suitable color display. This is because the fluorescent layers 75R, 75G and 75B emit visible light in different luminance when irradiated with the same quantity of ultraviolet rays, due to the characteristics of the fluorescent materials. Therefore, in the conventional AC-PDPs 101P and 102P adjust the emission times of the aforementioned three luminescent colors is adjusted in order to obtain white at a desired color temperature. More specifically, in the conventional AC-PDPs 101P and 102P, the number of actual pulses input in the sustain electrodes 10P and 20P and the sustain electrodes 110P and 120P is adjusted for each luminescent color by multiplying the number of pulses of input signals by a prescribed coefficient defined on the basis of emission characteristics of the fluorescent layers 75R, 75G and 75B.

Figure 18:
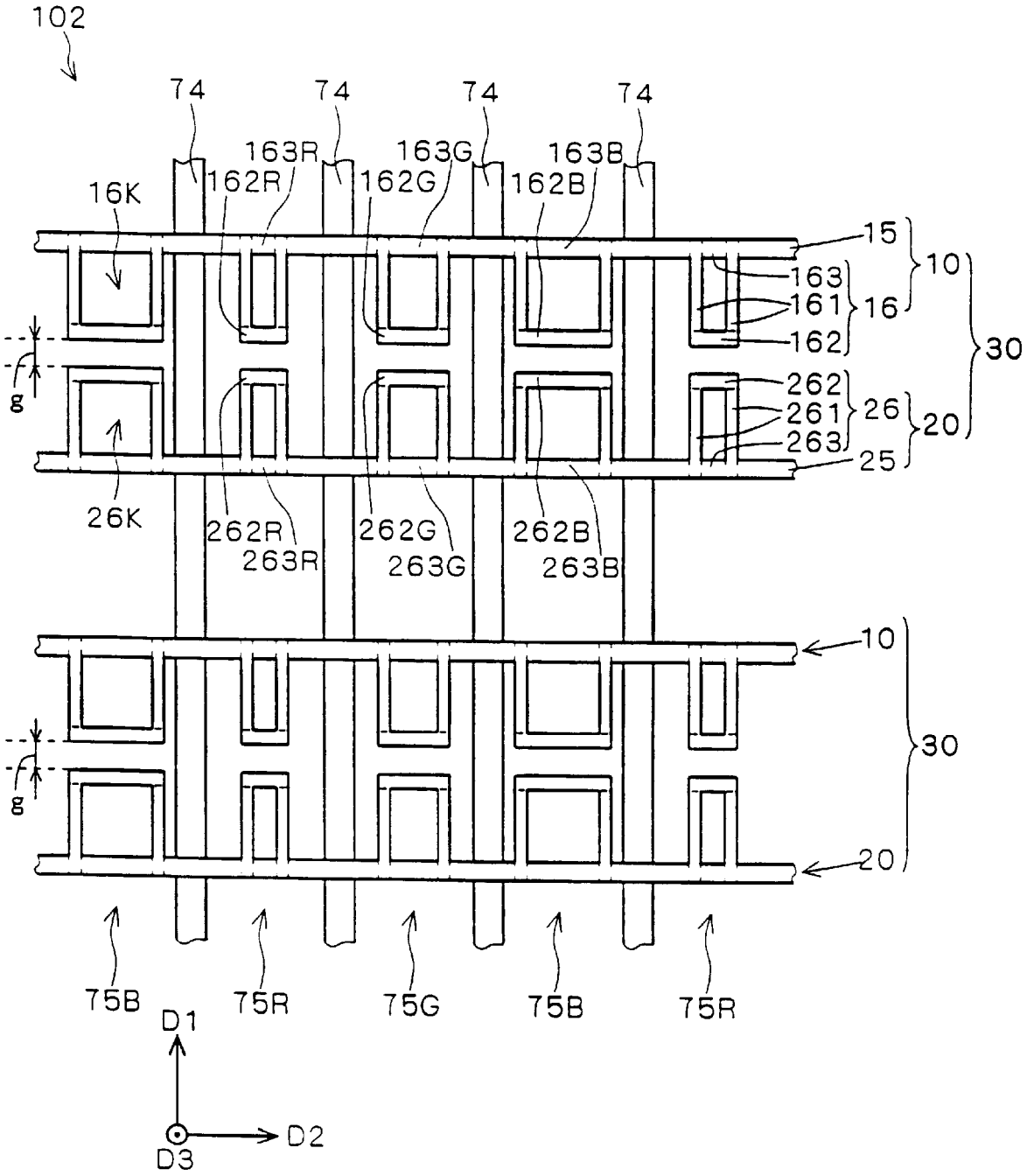
FIG. 18 is a typical top plan view for illustrating an electrode structure of an AC-PDP according to an embodiment 5 of the present invention.

On the other hand, an AC-PDP 102 according to an embodiment 5 of the present invention can eliminate such signal processing. The AC-PDP 102 is now described with reference to FIG. 18. FIG. 18 is a typical top plan view corresponding to FIG. 1. The feature of the AC-PDP 102 resides in shapes of sustain electrodes 10 and 20, and hence the following description is made with reference to this point. Further, the following description is made with reference to such a case that the magnitudes of luminous intensity are in order of (red)>(green)>(blue) when the same quantity of ultraviolet rays are irradiated.

As shown in FIG. 18, sizes of projecting portions 16 and 26 along a second direction D2 vary with luminescent colors emitted from fluorescent materials 75R, 75G and 75B facing the projecting portions 16 and 26 in the AC-PDP 102. In other words, the sizes of the projecting portions 16 and 26 along the second direction D2 are defined for the respective luminescent colors emitted by the fluorescent materials 75R, 75G and 75B, facing the projecting portions 16 and 26, arranged in a space defined by a front panel (first substrate), the aforementioned second substrate and barrier ribs 74 of the AC-PDP 102.

More specifically, sizes of second portions 162 and 262 and third portions 163 and 263 of the projecting portions 16 and 26 along the second direction D2 are set to satisfy the relation (second portions 162R and 262R and third portions 163R and 263R facing the fluorescent material 75R for emitting red)<(second portions 162G and 262G and third portions 163G and 263G facing the fluorescent material 75G for emitting green)<(second portions 162B and 262B and third portions 163B and 263B facing the fluorescent material 75B for emitting blue). At this time, electrode areas of all the projecting portions 16 are not identical to each other among three electrode pairs 30 including an electrode pair 30 for emitting red, an electrode pair 30 for emitting green and an electrode pair 30 for emitting blue.

According to such size setting, a discharge current (and hence the quantity of ultraviolet rays resulting from discharge) can be increased as the size of the projecting portions 16 and 26 along the second direction D2, i.e., the electrode area of the projecting portions 16 and 26 is increased. Therefore, the quantity of ultraviolet rays applied to the fluorescent layers 75R, 75G and 75B for emitting the respective luminescent colors can be corrected/adjusted respectively due to the difference between the sizes. Thus, in the AC-PDP 102, the sizes of the projecting portions 16 and 26 respectively are adjusted/set so that the sum of all luminescent colors reaches a desired white color temperature when discharges are caused in light emitting cells of the respective luminescent colors with the same number of pulses. It is assumed that discharge gaps g are identical in size to each other.

Thus, the AC-PDP 102 can attain emission of a desired white color temperature by a simple method of varying the sizes of the projecting portions 16 and 26. Therefore, it is possible to eliminate the aforementioned signal processing of input signals and a circuit for the signal processing dissimilarly to the conventional AC-PDPs 101P and 102P.

Considering the point that the quantity of discharge current depends on the electrode area as described above, the electrode area may be varied with the widths of the first portions 161 and 261 to third portions 163 and 263 forming the projecting portions 16 and 26.

<Embodiment 6>

Figure 19:
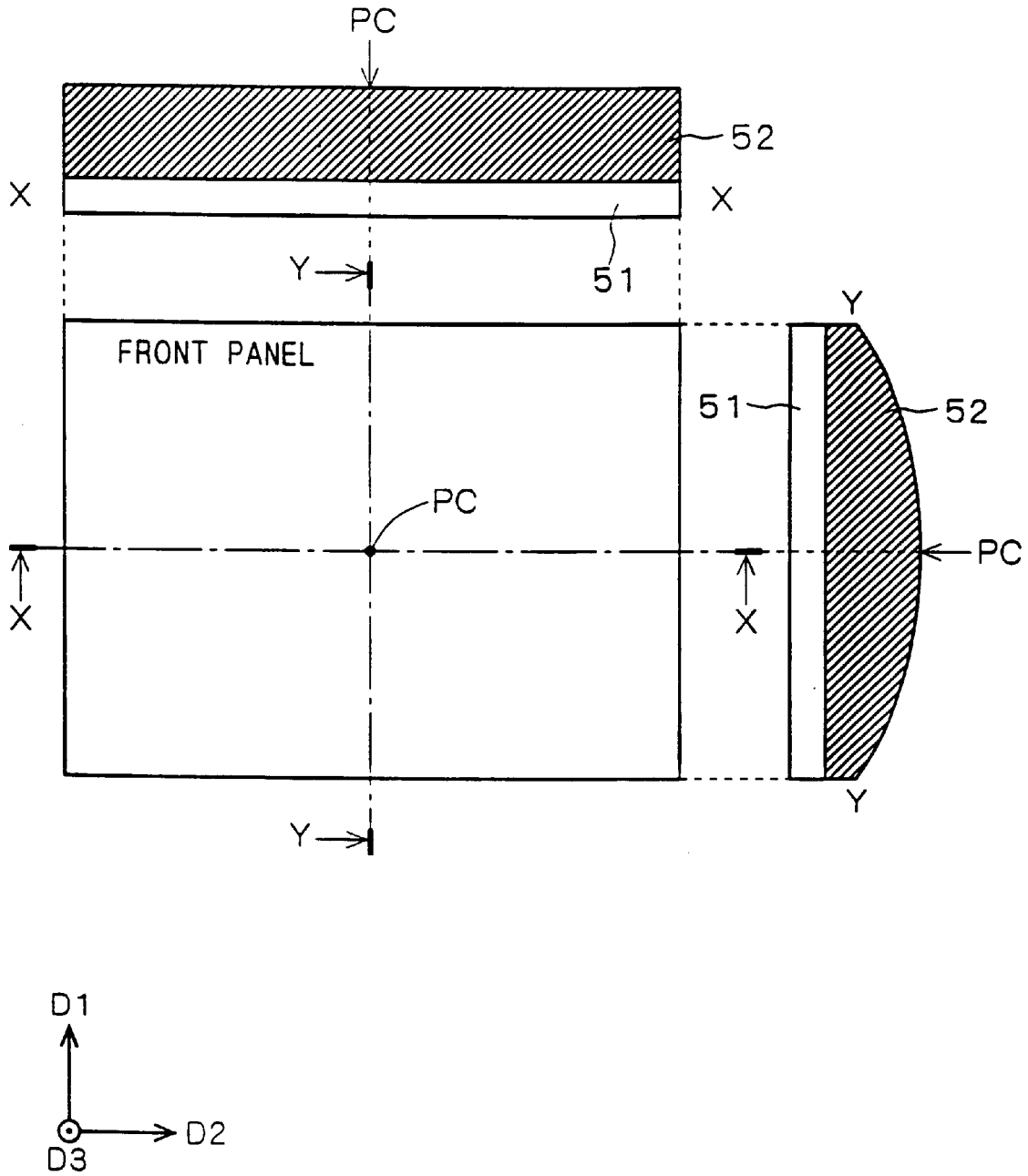
FIG. 19 is a model diagram for illustrating thickness distribution of a dielectric layer formed by screen printing.

In general, a dielectric layer 52 has distribution of thicknesses resulting from a forming method. A protective film 53 is formed by a thin film, and hence the thickness distribution of the dielectric layer 52 is reflected on thickness distribution of the dielectric layer 54. FIG. 19 is a model diagram showing thickness distribution of a dielectric layer 52 formed by screen printing, for example. FIG. 19 shows a typical top plan view showing a front panel, a longitudinal sectional view taken along the line X—X passing through the center PC of the front panel in parallel with a second direction D2, and a longitudinal sectional view taken along the line Y—Y passing through the center PC in parallel with a first direction D1.

As shown in FIG. 19, thickness distribution of the dielectric layer 52 along longer sides of a glass substrate 51 is substantially uniform. On the other hand, thickness distribution of the dielectric layer 52 along shorter sides of the glass substrate 51 is largest around the center PC of the front panel and reduced toward end portions, as shown in FIG. 19. This conceivably results from distribution of tension of a screen in screen printing. When the dielectric layer 52 has thickness direction, reproducible luminance unevenness corresponding to the aforementioned thickness distribution may take place to reduce display quality of an AC-PDP.

In order to eliminate such luminance unevenness, a dielectric layer 52 having a uniform thickness all over the front panel may be formed. However, it is extremely difficult to form a dielectric layer 52 having a uniform thickness on a large-sized glass substrate 51 of 40 inches, for example, by an existing forming method.

An embodiment 6 of the present invention is described with reference to an AC-PDP inducing no luminance unevenness also when a dielectric layer 52 or 54 has thickness distribution. While it is assumed that the dielectric layer 52 has the aforementioned thickness distribution shown in FIG. 19, the following description is appropriate for various types of thickness distribution.

Figure 20:
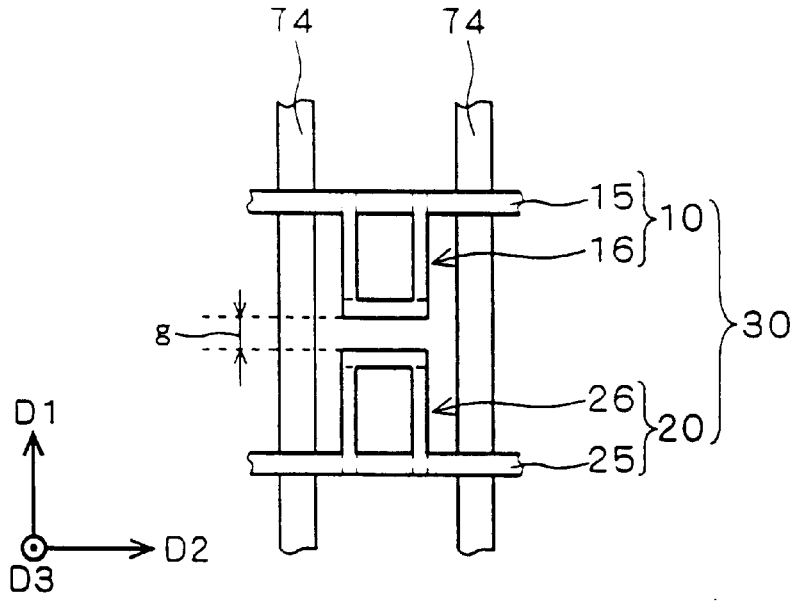
FIGS. 20 to 22 are typical top plan views for illustrating an electrode structure of an AC-PDP according to an embodiment 6 of the present invention.

In the AC-PDP according to the embodiment 6, a sustain electrode pair 30 shown in FIG. 20 comprising the aforementioned projecting portions 16 and 26 is arranged on portions around ends of a front panel along a first direction D1 forming a thin portion of a dielectric layer 52. A sustain electrode pair 30*e* or a sustain electrode pair 31*f* having projecting portions 16*e* and 26*e* or 16*f* and 26*f* shown in FIG. 21 or 22 is arranged along the first direction D1 toward the center PC of the front panel, i.e., as the dielectric layer 52 is increased in thickness.

Figure 21:
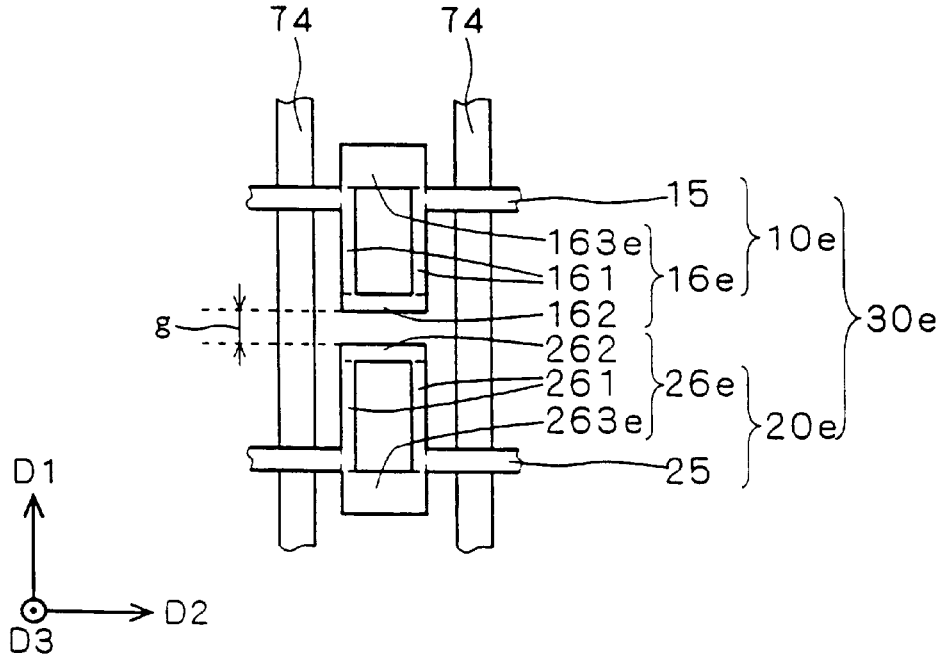
Figure 22:
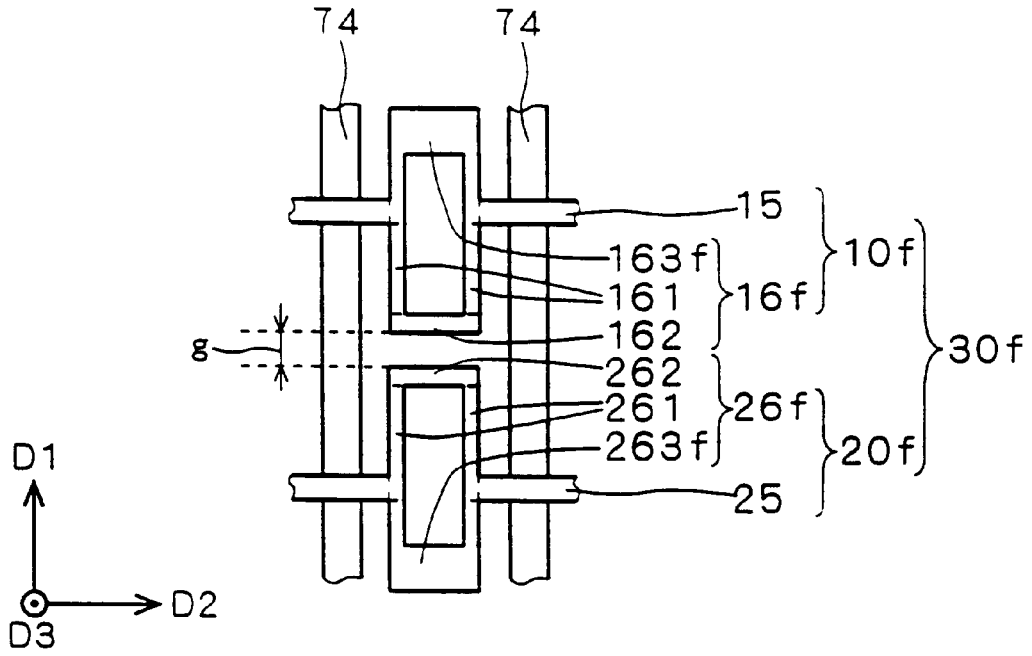

The electrode pairs 30*e* and 30*f* shown in FIGS. 21 and 22 are now described. As shown in FIG. 21, the sustain electrode pair 30*e* is formed by sustain electrodes 10*e* and 20*e*, which have (i) the aforementioned base portions 15 and 25. (ii) The projecting portions 16*e* and 26*e* of the sustain electrodes 10*e* and 20*e* comprise the aforementioned first and second portions 161, 261, 162 and 262 and third portions 163*e* and 263*e* corresponding to the aforementioned third portions 163 and 263 (see FIG. 1). The third portions 163*e* and 263*e* are coupled with ends of the first portions 161 and 261 in a first direction D1 to connect the pairs of first portions 161 and 261 with each other.

As shown in FIG. 22, the sustain electrode pair 30*f* is formed by sustain electrodes 10*f* and 20*f*, which comprise (i) the aforementioned base portions 15 and 25 and (ii) the projecting portions 16*f* and 26*f* formed by the first and second portions 161, 261, 162 and 262 and third portions 163*f* and 263*f* equivalent to the aforementioned third portions 163*e* and 263*e*. The third portions 163*e* and 263*e* are rectangular as shown in FIG. 21, while the third portions 163*f* and 263*f* are U-shaped as shown in FIG. 22.

Comparing FIGS. 20, 21 and 22 with each other, it is understood that the projecting portions 16 and 26 are extended toward a side opposite to a discharge gap g as in order of the projecting portions 16 and 26→the projecting portions 16*e* and 26*e*→the projecting portions 16*f* and 26*f*. That is, in three electrode pairs 30, 30*e* and 30*f* lined in the first direction D1, electrode areas of all the projecting portions 16, 16*e* and 16*f* are not identical to each other.

According to such setting of electrode areas of the projecting portions based on the thickness of the dielectric layer 52, projecting portions having larger electrode areas are arranged on thicker portions of the dielectric layer 52 so that a larger quantity of discharge current can be fed. Therefore, prescribed quantities of ultraviolet rays can be generated in all discharge cells independently of the thickness distribution of the dielectric layer 52. Consequently, the AC-PDP according to the embodiment 6 can attain even luminance all over the AC-PDP. The third portions 163*f* and 263*f* may alternatively be rectangular, similarly to the third portions 163*e* and 263*e*.

<Modification 1 of Embodiment 6>

Also when the protective film 53 has distribution of secondary-electron emission efficiency in its plane, luminance unevenness corresponding to the distribution is observed. Such in-plane distribution of the secondary-electron emission efficiency depends on a film forming apparatus for the protective film 53 itself. It also depends on film forming conditions such as the position of arrangement of the glass substrate 51 (formed with the dielectric layer 52), the number of the glass substrates 57, or the like, in the film forming apparatus. In other words, the distribution of the secondary-electron emission efficiency has a tendency every film forming apparatus and every film forming condition. In consideration of this point, the aforementioned luminance unevenness can be reduced/removed by finding such a tendency and defining the electrode area of each projecting portion on the basis of each secondary-electron emission efficiency of a portion corresponding to each projecting portion, more specifically by arranging a projecting portion having a larger electrode area under a portion having lower secondary-electron emission efficiency.

Display quality can be further improved by designing electrode areas of projecting portions on the basis of both the distribution of the secondary-electron emission efficiency and the thickness distribution of the dielectric layer 52, as a matter of course.

Display quality can be remarkably improved by designing the electrode areas of the projecting portions of the AC-PDP according to the embodiment 6 (including the aforementioned modification 1) also in consideration of design of a white color temperature, similarly to the aforementioned AC-PDP 102.

The sustain electrode pair 30*a* etc. according to the aforementioned modification 1 etc. of the embodiment 1 may be applied to each of the AC-PDPs according to the embodiments 5 and 6, or sustain electrodes having different electrode areas may be combined to form a sustain electrode pair.

<Embodiment 7>

Figure 23:
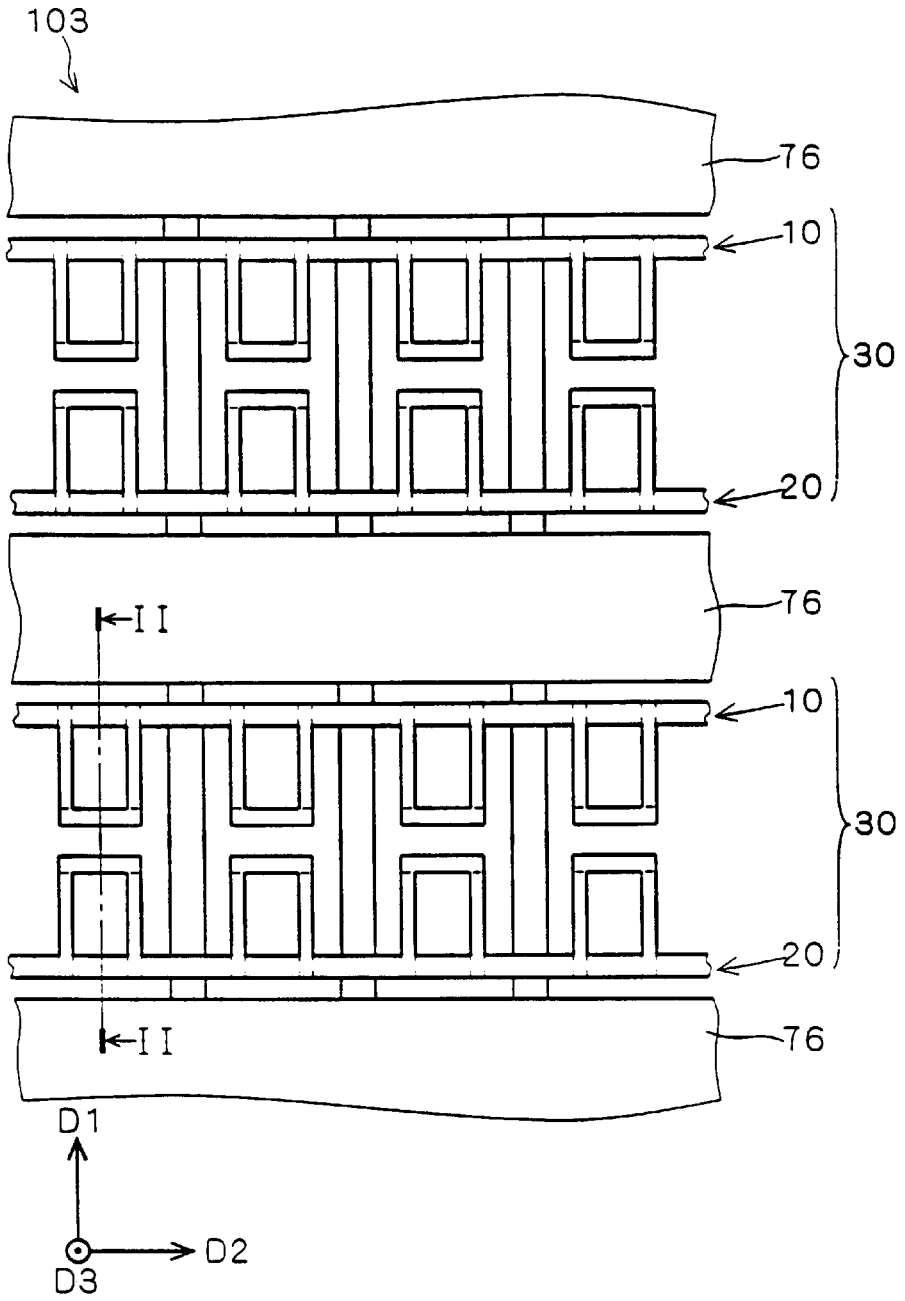
FIG. 23 is a typical top plan view for illustrating the structure of a front panel of an AC-PDP according to an embodiment 7 of the present invention.
Figure 24:
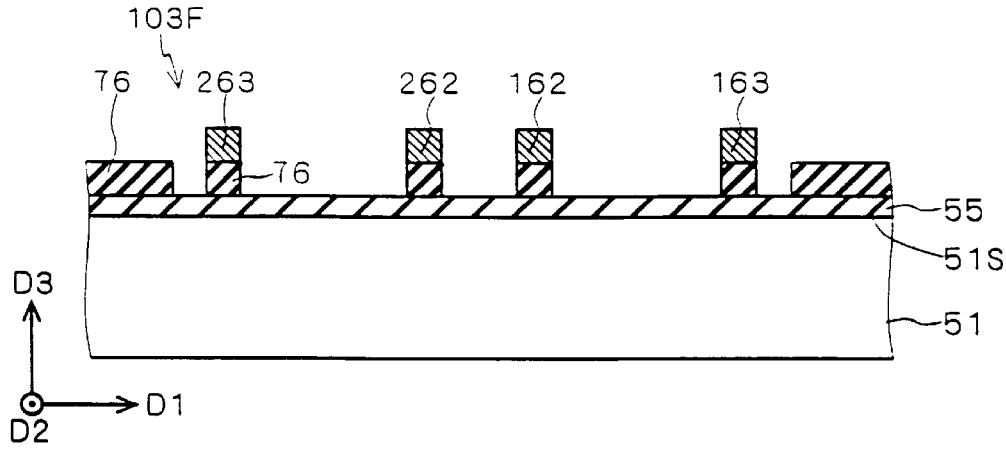
FIG. 24 is a typical longitudinal sectional view for illustrating the structure of the front panel of the AC-PDP according to the embodiment 7.
Figure 25:
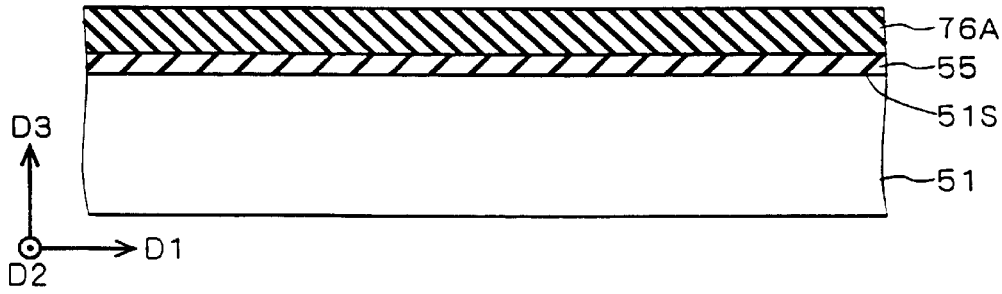
FIGS. 25 to 29 are typical longitudinal sectional views for illustrating a method of manufacturing the front panel of the AC-PDP according to the embodiment 7.

FIGS. 23 and 24 are a typical top plan view and a typical longitudinal sectional view for illustrating the structure of an AC-PDP 103 or a front panel 103F according to an embodiment 7 of the present invention. FIG. 24 corresponds to a longitudinal sectional view taken along the line II—II in FIG. 23 as viewed along arrows. While the front panel 103F has sustain electrodes 10 and 20 in this embodiment, the following description is appropriate also in the case of other sustain electrodes 10*a* and 20*a* etc.

As shown in FIGS. 23 and 24, the front panel 103F comprises the sustain electrodes 10 and 20 above a glass substrate 51 through an underlayer 55. In particular, a black pattern (a black insulating layer) 76 is formed on a surface of the underlayer 55 opposite to the glass substrate 51. The black pattern 76 includes (i) a portion having a shape similar to those of the sustain electrodes 10 and 20 to be arranged between the sustain electrodes 10 and 20 and the underlayer 55 and (ii) a portion arranged between adjacent sustain electrode pairs 30 in a first direction D1 in the top plan view shown in FIG. 23 similarly to the black stripe 76P (see FIG. 30). The black pattern 76 is made of low melting point glass including a black pigment of chromium oxide or iron oxide, for example.

While the front panel 103F comprises the dielectric layer 52 and the protective film 53 shown in the aforementioned FIG. 2, illustration of these in FIGS. 23 and 24 is omitted for avoiding complication of the figures. The conventional rear panel 101 RP is applicable as a rear panel forming the AC-PDP 103 with the front panel 103F.

The front panel 103F and the AC-PDP 103 comprising this front panel 103F can suppress reflection of external light by the black pattern 76. Therefore, contrast can be improved as compared with the case of having no black pattern 76.

As described above, in the conventional AC-PDP 101P (see FIG. 30), the in-electrode black layer is made of a conductive material while the black stripe pattern 76P is made of an insulating material. On the other hand, the front panel 103F is different from the conventional front panel 101FP in a point that the black pattern 76 according to the embodiment 7 is made of an insulating material or a dielectric material regardless of the position of arrangement thereof.

Methods of manufacturing the black pattern 76 and sustain electrodes 10 and 20 are now described with reference to respective longitudinal sectional views shown in FIGS. 25 to 29.

First, the underlayer 55 is formed on a main surface 51S of the glass substrate 51. Thereafter a low melting point glass paste material is applied to the exposed surface of the underlayer 55 by screen printing or die coating, for example, for forming a photosensitive black thick film 76A (see FIG. 25). In particular, the aforementioned low melting point glass paste material or the photosensitive black thick film 76A contains a black pigment of chromium oxide or iron oxide and negative photosensitive resin.

Figure 26:
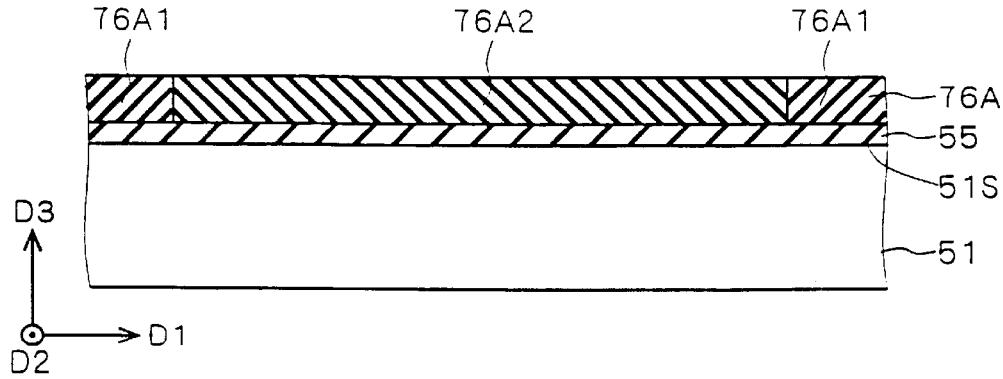

Thereafter the photosensitive black thick film 76A is pattern-exposed through a mask or the like for polymerizing the photosensitive resin in regions 76A1 corresponding to portions arranged between the adjacent sustain electrode pairs 30 in the black pattern 76 (see FIG. 26).

Figure 27:
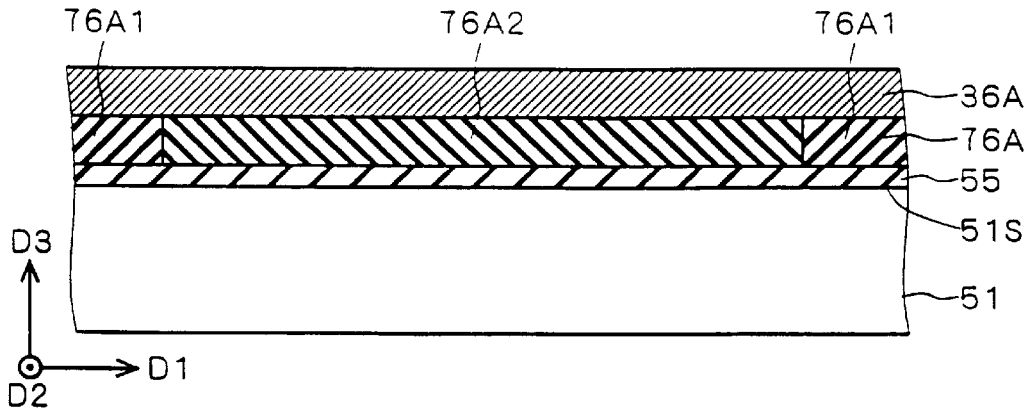
Figure 28:
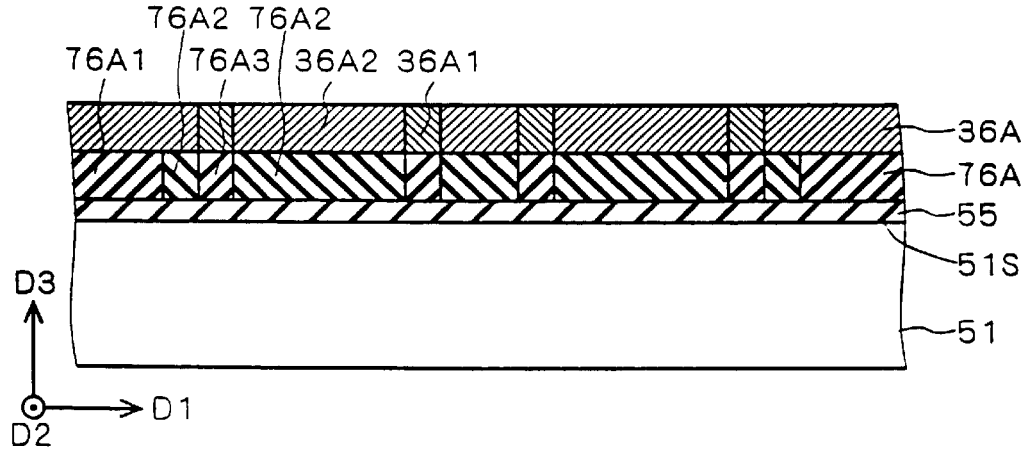

Then, negative photosensitive Ag paste is applied onto the exposed surface of the photosensitive black thick film 76A for forming a photosensitive Ag thick film 36A (see FIG. 27).

Thereafter the photosensitive Ag thick film 36A and unexposed regions or unpolymerized regions 76A2 of the photosensitive black thick film 76A are photosensitized through, e.g., a mask having openings corresponding to the shapes of the sustain electrodes 10 and 20. Due to such exposure, polymerization is caused on regions 36A1 of the photosensitive Ag thick film 36A for defining the sustain electrodes 10 and 20 later while causing polymerization on regions 76A3 of the unexposed regions 76A2 located between the aforementioned regions 36A1 and the underlayer 55. The regions 76A3 define portions arranged between the sustain electrodes 10 and 20 and the underlayer 55 in the black pattern 76 later.

Figure 29:
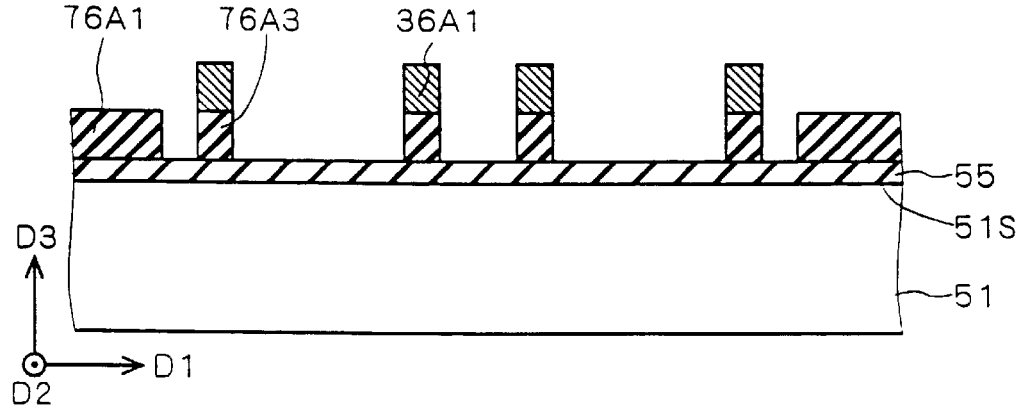

Development is performed for removing unpolymerized regions 36A2 of the photosensitive Ag thick film 36A and the unpolymerized regions 76A2 of the photosensitive black thick film 76A (see FIG. 29). Thereafter the remaining regions 36A1 of photosensitive Ag thick film and regions 76A1 and 76A3 of photosensitive black thick film are sintered for forming the sustain electrodes 10 and 20 and the black pattern 76 (see FIG. 24). Thereafter the dielectric layer 52 and the protective film 53 are formed for completing the front panel 103F.

As described above, the black pattern 76 is entirely made of an insulating material regardless of the position of arrangement thereof. Therefore, it is not at all necessary to provide different steps for forming the black pattern 76, dissimilarly to the case of the conventional in-electrode black layer and the conventional black stripe pattern 76P. In other words, the front panel 103F and the AC-PDP 103 capable of improving contrast can be manufactured through a smaller number of steps as compared with the conventional front panel 101FP.

According to the aforementioned manufacturing method, further, the photosensitive Ag thick film 36A and the photosensitive black thick film 76A are simultaneously or collectively exposed when patterning the sustain electrodes 10 and 20. Therefore, no misalignment takes place between the sustain electrodes 10 and 20 and the black pattern 76.

In addition, the photosensitive Ag thick film 36A and the photosensitive black thick film 76A are simultaneously developed, whereby the number of steps can be reduced also in this point.

While the invention has been shown and described in detail, the foregoing description is in all aspects illustrative and not restrictive. It is therefore understood that numerous modifications and variations can be devised without departing from the scope of the invention.

What is claimed is:

1. A substrate for a plasma display panel comprising:

a) a transparent substrate;

b) at least one pair of electrodes made of opaque conductive silver (Ag), formed by applying and sintering a paste of said silver, and arranged on the side of one main surface of said transparent substrate, each electrode having a base portion and a projecting portion which is coupled with said base portion and projects from said base portion along said main surface, each of said projecting portions including:

1) a first portion coupled with said base portion to extend in a projecting direction of said projecting portion, and 2) a second portion coupled with an end of said first portion separated from said base portion; and c) an underlayer arranged between said transparent substrate and said electrodes, in contact with said electrodes, and formed of a transparent dielectric substance formed at a temperature below the softening point of said transparent substrate;

wherein said second portions of said projecting portions of said electrodes face each other to form a discharge gap between said projecting portions;

wherein said at least one pair of electrodes includes a plurality of pairs of electrodes arranged at a prescribed pitch in a projecting direction of said projecting portion, and $$b<(p-g-115)/2.42$$

wherein:

p ($\mu$m) represents said prescribed pitch, and b ($\mu$m) and g (em) represent respective lengths of said projecting portion and of said discharge gap in said projecting direction.

2. A substrate for a plasma display panel comprising:

a) a transparent substrate;

b) at least one pair of electrodes made of opaque conductive silver (Ag), formed by applying and sintering a paste of said silver, and arranged on the side of one main surface of said transparent substrate, each electrode having a base portion and a projecting portion which is coupled with said base portion and projects from said base portion along said main surface, each of said projecting portions including:

1) a first portion coupled with said base portion to extend in a projecting direction of said projecting portion, and 2) a second portion coupled with an end of said first portion separated from said base portion; and c) an underlayer arranged between said transparent substrate and said electrodes, in contact with said electrodes, and formed of a transparent dielectric substance formed at a temperature below the softening point of said transparent substrate;

wherein:

said second portions of said projecting portions of said electrodes face each other to form a discharge gap between said projecting portions, said at least one pair of electrodes includes a plurality of pairs of electrodes, and electrode areas of all said projecting portions are not identical to each other.

3. The substrate for a plasma display panel according to claim 2, further comprising:

a dielectric layer covering said projecting portions;

wherein said electrode area of each said projecting portion is set on the basis of thickness of a portion of said dielectric layer covering each said projecting portion.

4. The substrate for a plasma display panel according to claim 2, further comprising:

a secondary-electron emission film over said projecting portions;

wherein said electrode area of each said projecting portion is set on the basis of secondary-electron emission efficiency of a portion of said secondary-electron emission film corresponding to each said projecting portion.

* * * * *